US008277909B2

(12) United States Patent
Simpson et al.

(10) Patent No.: US 8,277,909 B2
(45) Date of Patent: Oct. 2, 2012

(54) TRANSPARENT INK-JET RECORDING FILMS, COMPOSITIONS, AND METHODS

(75) Inventors: Sharon M. Simpson, Lake Elmo, MN (US); James B. Philip, Jr., Mahtomedi, MN (US); William D. Devine, Fort Collins, CO (US); William J. Ruzinsky, Loveland, CO (US); James L. Johnston, Brighton, CO (US); Daniel P. Leach, Rochester, NY (US); David G. Baird, Woodbury, MN (US); James R. Wagner, Jr., Stillwater, MN (US); Heidy M. Vosberg, Lake Elmo, MN (US); John D. Szafraniec, Bloomington, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/273,260

(22) Filed: Oct. 14, 2011

(65) Prior Publication Data

US 2012/0100315 A1 Apr. 26, 2012

Related U.S. Application Data

(60) Provisional application No. 61/405,671, filed on Oct. 22, 2010, provisional application No. 61/415,954, filed on Nov. 22, 2010, provisional application No. 61/490,619, filed on May 27, 2011.

(51) Int. Cl.
*B41M 5/00* (2006.01)

(52) U.S. Cl. ..... 428/32.13; 428/32.14; 428/32.15; 428/32.22; 428/32.27; 428/32.28; 428/32.34

(58) Field of Classification Search ..... 428/32.13, 428/32.14, 32.15, 32.22, 32.27, 32.28, 32.34
See application file for complete search history.

(56) References Cited

U.S. PATENT DOCUMENTS

| | | | | |
|---|---|---|---|---|
| 3,143,421 | A | 8/1964 | Nadeau et al. | |
| 4,365,423 | A | 12/1982 | Arter et al. | |
| 4,833,060 | A | 5/1989 | Nair et al. | |
| 5,354,799 | A | 10/1994 | Bennett et al. | |
| 5,795,708 | A | 8/1998 | Boutet | |
| 6,457,824 | B1 | 10/2002 | Wexler | |
| 6,555,301 | B2 | 4/2003 | Smith et al. | |
| 6,630,283 | B1 | 10/2003 | Simpson et al. | |
| 2003/0081103 | A1 * | 5/2003 | Ishimaru et al. | 347/105 |
| 2004/0022968 | A1 | 2/2004 | Liu et al. | |
| 2005/0239646 | A1 | 10/2005 | Hada et al. | |
| 2010/0075042 | A1 | 3/2010 | Friour et al. | |
| 2012/0009364 | A1 * | 1/2012 | Simpson et al. | 428/32.14 |

OTHER PUBLICATIONS

International Search Report, International Application No. PCT/US2011/056513, dated Feb. 16, 2012, 2 pages.
Research Disclosure 308119, Dec. 1989, 46 pages.
Commonly assigned U.S. Appl. No. 13/176,788, entitled: Transparent Ink-Jet Recording Film, filed on Jul. 6, 2011, by Simpson et al.
Commonly assigned U.S. Appl. No. 13/208,379, entitled: Transparent Ink-Jet Recording Films, Compositions, and Methods, filed on Aug. 12, 2011, by Simpson et al.

* cited by examiner

*Primary Examiner* — Betelhem Schewareged
(74) *Attorney, Agent, or Firm* — Reed L. Christiansen

(57) ABSTRACT

Transparent ink-jet recording films, compositions, and methods are disclosed. These films can exhibit high maximum optical densities, rapid ink drying, low curl, excellent adhesion between the coating layers and the substrate, and negligible ink transfer between stacked ink-jet recording films after imaging. Such films are useful in medical imaging applications.

15 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/405,671, filed Oct. 22, 2010, entitled TRANSPARENT INK-JET RECORDING FILMS, COMPOSITIONS, AND METHODS, U.S. Provisional Application No. 61/415,954, filed Nov. 22, 2010, entitled TRANSPARENT INK-JET RECORDING FILMS, COMPOSITIONS, AND METHODS, and U.S. Provisional Application No. 61/490,619, filed May 27, 2011, entitled TRANSPARENT INK-JET RECORDING FILMS, COMPOSITIONS, AND METHODS, each of which is hereby incorporated by reference in its entirety.

SUMMARY

Transparent ink-jet recording films often employ one or more image-receiving layers on one or both sides of a transparent support. In order to obtain high image densities when printing on transparent films, more ink is often applied than is required for opaque films. To be able to accommodate more printing ink, image-receiving layer thicknesses can be increased relative to those in opaque films. The compositions and methods of the present application can provide transparent ink-jet recording films with increased image-receiving layer thicknesses. Such films can exhibit high maximum optical densities, rapid ink drying, low curl, excellent adhesion between the coating layers and the substrate, and negligible ink transfer between adjacent ink-jet recording films after imaging.

At least one embodiment provides a transparent ink-jet recording film comprising a transparent substrate comprising a polyester, where the substrate comprises at least a first surface and a second surface. The transparent ink-jet recording film may further comprise at least one under-layer disposed on the first surface, where the at least on under-layer comprises gelatin and at least one borate or borate derivative. The transparent ink-jet recording film may further comprise at least one image-receiving layer disposed on the at least one under-layer, where the at least one image-receiving layer comprises at least one inorganic particle and at least one water soluble or water dispersible polymer comprising at least one hydroxyl group. The transparent ink-jet recording film may further comprise at least one back-coat layer disposed on the second surface, where the at least one back-coat layer comprises gelatin and at least one core-shell particle comprising at least one thermoplastic polymer.

In at least some embodiments, the at least one thermoplastic polymer may, for example, comprise a styrene allyl alcohol copolymer.

In at least some embodiments, the at least one core shell particle may, for example, comprise a styrene allyl alcohol polymer core and a colloidal silica shell.

In at least some embodiments, the at least one core-shell particle comprises a dry coverage of at least about 100 mg/m$^2$. In some cases, the at least one core-shell polymer may comprise a dry coverage of at least about 120 mg/m$^2$, such as, for example, a dry coverage of at least about 120 mg/m$^2$ and less than about 200 mg/m$^2$. Or the at least one core-shell polymer may, for example, comprise a dry coverage of at least about 100 mg/m$^2$ and less than about 1000 mg/m$^2$, or a dry coverage of at least about 100 mg/m$^2$ and less than about 500 mg/m$^2$.

In at least some embodiments, the at least one back-coat layer may further comprise at least one other hydrophilic colloid, such as, for example, sodium carboxymethylate casein or a polyacrylamide. In some cases, the at least one back-coat layer may comprise both sodium carboxymethylate casein and a polyacrylamide.

In at least some embodiments, the at least one back-coat layer may further comprise at least one polysiloxane.

In at least some embodiments, the at least one back-coat layer may further comprise at least one hardening agent, such as, for example, bis(vinylsulfonyl)methane or chrome alum. In some cases, the at least one back-coat layer may comprise both bis(vinylsulfonyl)methane and chrome alum.

In at least some embodiments, the at least one back-coat layer may comprise at least one first layer and at least one second layer, where the at least one first layer is disposed between the at least one second layer and the second surface of the substrate. The at least one first layer may, for example, comprise gelatin and at least one first hardening agent, such as, for example, bis(vinylsulfonyl)methane. The at least one second layer may, for example, comprise gelatin and the at least one core-shell particle. In some cases, the at least one second layer further comprises at least one other hydrophilic colloid comprising at least one of sodium carboyxmethylate casein or a polyacrylamide, or, for example, the at least one second layer may comprise both sodium carboxymethylate casein and a polyacrylamide. In at least some cases, the at least one second layer further comprises at least one polysiloxane. In some cases, the at least one second layer further comprises at least one second hardening agent, such as, for example, chrome alum.

In at least some embodiments, the at least one inorganic particle may, for example, comprise boehmite alumina.

In at least some embodiments, the at least one borate or borate derivative may comprise at least one hydrate of sodium tetraborate, such as, for example, sodium tetraborate decahydrate.

In at least some embodiments, the at least one water soluble or water dispersible polymer may, for example, comprise poly(vinyl alcohol).

In at least some embodiments, the at least one image-receiving layer may comprise a dry coating weight of at least about 49 g/m$^2$.

Such transparent ink-jet recording films may, in some cases, exhibit an ink transfer measurement of zero squares transferred, based on 390¼-in×¼-in squares, when subjected to a compression of 5.7 psi pressure and 85% relative humidity for seven days. Or such films may, for example, exhibit an ink transfer measurement of zero squares transferred, based on 390⅛-in×⅛-in squares, when subjected to a compression of 0.081 psi pressure and 86% relative humidity for four days.

At least some embodiments provide such transparent ink-jet recording films further comprising at least one first subbing layer disposed between the first surface of the transparent substrate and the at least one under-layer. Such a first subbing layer may, in some cases, comprise gelatin and at least one first polymeric matting agent. Such polymeric matting agents may, for example, comprise poly(methyl methacrylate-co-ethylene glycol dimethacrylate).

In at least some embodiments, such transparent ink-jet recording films may further comprise at least one second subbing layer disposed between the second surface of the transparent substrate and the at least one back-coat layer. Such a second subbing layer may, in some cases, comprise gelatin and at least one second polymeric matting agent. Such polymeric matting agents may, for example, comprise poly (methyl methacrylate-co-ethylene glycol dimethacrylate).

Some embodiment further provide at least one primer layer disposed between the at least one first subbing layer and the at least one first surface of the transparent substrate or between the at least one second subbing layer and the at least one second surface of the transparent substrate. Such a primer layer may, in some cases, comprise at least one latex polymer and at least one adhesion promoter. Such latex polymers may, for example, comprise poly(vinylidene chloride-co-methyl acrylate-co-itaconic acid). It at least some embodiments, the at least one adhesion promoter may, for example, comprise resorcinol.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art.

DETAILED DESCRIPTION

All publications, patents, and patent documents referred to in this document are incorporated by reference herein in their entirety, as though individually incorporated by reference.

U.S. Provisional Application No. 61/405,671, filed Oct. 22, 2010, entitled TRANSPARENT INK-JET RECORDING FILMS, COMPOSITIONS, AND METHODS, U.S. Provisional Application No. 61/415,954, filed Nov. 22, 2010, entitled TRANSPARENT INK-JET RECORDING FILMS, COMPOSITIONS, AND METHODS, and U.S. Provisional Application No. 61/490,619, filed May 27, 2011, entitled TRANSPARENT INK-JET RECORDING FILMS, COMPOSITIONS, AND METHODS, are each hereby incorporated by reference in its entirety.

Introduction

An ink-jet recording film may comprise at least one image-receiving layer, which receives ink from an ink-jet printer during printing, and a substrate or support, which may be opaque or transparent. An opaque support may be used in films that may be viewed using light reflected by a reflective backing, while a transparent support may be used in films that may be viewed using light transmitted through the film.

Some medical imaging applications require high image densities. For a reflective film, high image densities may be achieved by virtue of the light being absorbed on both its path into the imaged film and again on the light's path back out of the imaged film from the reflective backing. On the other hand, for a transparent film, because of the lack of a reflective backing, achievement of high image densities may require application of larger quantities of ink than are common for opaque films.

Application of such quantities of ink during printing increases the amount of carrier fluids that must be removed after printing. Because of the high throughput of many ink-jet printers, the removal of such carrier fluids may be incomplete, possibly resulting in wet media and adhesion between the image-carrier layer of one media sheet and the back-coat layer of an adjacent sheet. In some cases, ink may be transferred between the two sheets, affecting the quality of the printed image.

Use of higher image-receiving layer coating weights has been found to be one factor that can improve drying performance, but such high coating weights can introduce appreciable curl in the end-use film.

Transparent ink-jet films, compositions, and methods are presented that provide superior ink drying and ink transfer performance when printed to optical densities of, for example, at least about 2.8, without exhibiting unacceptable curl.

Transparent Ink-Jet Films

Transparent ink-jet recording films are known in the art. See, for example, U.S. patent application Ser. No. 13/176,788, "TRANSPARENT INK-JET RECORDING FILM," by Simpson et al., filed Jul. 6, 2011, and U.S. patent application Ser. No. 13/208,379, "TRANSPARENT INK-JET RECORDING FILMS, COMPOSITIONS, AND METHODS," by Simpson et al., filed Aug. 12, 2011, both of which are hereby incorporated by reference in their entirety.

Transparent ink-jet recording films may comprise one or more transparent substrates. In some embodiments, the film may comprise at least one primer layer coated on a first surface of the one or more transparent substrates. In other embodiments, the film may comprise at least one subbing layer coated on the first surface of the one or more transparent substrates. In still other embodiments, the film may comprise at least one primer layer coated on the first surface of the one or more transparent substrates and at least one subbing layer coated on the at least one primer layer.

In some embodiments, the film may comprise at least one primer layer coated on a second surface of the one or more transparent substrates. In other embodiments, the film may comprise at least one subbing layer coated on the second surface of the one or more transparent substrates. In still other embodiments, the film may comprise at least one primer layer coated on the second surface of the one or more transparent substrates and at least one subbing layer coated on the at least one primer layer.

In other embodiments, at least one primer layer may be coated on both a first surface and a second surface of the one or more transparent substrates. Or at least one subbing layer may be coated on both a first surface and a second surface of the one or more transparent substrates. Or at least one primers may be coated on both a first surface and a second surface of the one or more transparent substrates, with at least one subbing layer being coated on each of the at least one primer layers.

Transparent ink-jet recording films may comprise one or more under-layers disposed on a first surface of the substrate. Such under-layers may, in some cases, be coated directly on a first surface of the transparent substrate. Or, in other cases, such under-layers may be coated on at least one subbing layer which may, in turn, be coated directly on the first surface of the transparent substrate. Or, in still other cases, such under-layers may be coated on at least one subbing layer which may, in turn, be coated on one or more primer layers which may, in turn, be coated on the first surface of the transparent substrate. Such an under-layer may optionally be dried before being further processed.

The film may further comprise one or more image-receiving layers coated upon at least one under-layer. Such an image-receiving layer is generally dried after coating.

In some embodiments, the film may further comprise additional layers, such as one or more back-coat layers or overcoat layers, as will be understood by those skilled in the art. Such back-coat layers may, in some cases, be coated directly on a second surface of the transparent substrate. Or, in other cases, such back-coat layers may be coated on at least one subbing layer which may, in turn, be coated directly on the second surface of the transparent substrate. Or, in still other cases, such back-coat layers may be coated on at least one subbing layer which may, in turn, be coated on one or more primer layers which may, in turn, be coated on the second surface of the transparent substrate.

Transparent Substrate

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Substrate Treatments

In some embodiments, one or more surfaces of the transparent substrate may be treated to improve adhesion to adjacent layers of the film. Such surface treatments may include, but are not limited to, chemical treatment, mechanical treatment, corona discharge, flame treatment, UV irradiation, radio-frequency treatment, glow discharge, plasma treatment, acid treatment, ozone oxidation, electron beam treatment, and the like. These and other such surface treatments are known to those of skill in the art.

Primer Layers

In some embodiments, one or more primer layers may be used to improve adhesion of the transparent substrate to other layers. Generally, such primer layers, when present, are adjacent to one or more of the substrate surfaces, with the other layers disposed on the primer layers. Primer layers may be used in combination with or in lieu of treatment of the substrate surface. In some embodiments, a primer layer may comprise a coating thickness of about 0.112 g/m$^2$ on a dry basis. Such primer layers may, for example, be coated and dried using processes similar to those described for applying under-layers and image-receiving layers.

Such primer layers may comprise adhesion promoters, such as phenolic or naphtholic compounds substituted with one or more hydroxyl groups, including but not limited to, for example, phenol, resorcinol, orcinol, catechol, pyrogallol, 2,4-dinitrophenol, 2,4,6-trinitrophenol, 4-chororesorcinol, 2,4-dihydroxy toluene, 1,3-naphthalenediol, the sodium salt of 1-naphthol-4-sulfonic acid, o-fluorophenol, m-fluorophenol, p-fluorophenol, o-cresol, p-hydroxybenzotrifluoride, gallic acid, 1-naphthol, chlorophenol, hexyl resorcinol, chloromethylphenol, o-hydroxybenzotrifluoride, m-hydroxybenzotrifluoride, p-chloro-m-xylenol, and the like. Other examples of adhesion promoters include acrylic acid, benzyl alcohol, trichloroacetic acid, dichloroacetic acid, chloral hydrate, ethylene carbonate, and the like. These or other adhesion promoters may be used as a single adhesion promoter or as mixtures of two or more adhesion promoters.

Such primer layers may comprise one or more polymers. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. Materials used in adhesion-promoting layers often comprise a copolymer containing a chloride group such as vinylidene chloride. In some embodiments, a terpolymer of monomers comprising about 83 wt % vinylidene chloride, about 15 wt % methyl acrylate, and about 2 wt % itaconic acid may be used, as described in U.S. Pat. No. 3,143,421 to Nadeau et al., which is hereby incorporated by reference in its entirety.

In some embodiments, the one or more polymers may be provided as a latex dispersion. Such a latex dispersion may be prepared by, for example, emulsion polymerization. In other embodiments, the one or polymers may be prepared by solution polymerization, followed by dispersion of the polymers in water to form a latex dispersion. Such polymers, when provided as a latex dispersion, may be referred to as latex polymers.

The one or more primer layer may optionally also comprise one or more surfactants, such as, for example, saponin. Such surfactants may be provided as part of one or more latex dispersions or may be provided in addition to any surfactants may be in such dispersions.

In some embodiments, the one or more primer layers may be applied to the transparent substrate prior to orientation of the substrate. Such orientation may comprise, for example, uniaxial or biaxial orientation at one or more temperatures above the glass transition temperature and below the melting temperature of the transparent substrate.

Subbing Layers

The one or more subbing layers may be applied to one or more surfaces of a transparent substrate or to one or more primer layers disposed on such surfaces. Generally, such subbing layers, when present, are adjacent to the one or more primer layers, when present, or are adjacent to one or more of the substrate surfaces, when the one or more primer layers are absent. In some embodiments, for example, where the one or more primer layers do not completely cover a substrate surface, the one or more subbing layer may be adjacent to both that substrate surface and to the one or more primer layers. In some embodiments, a subbing layer may comprise a coating thickness of about 0.143 g/m$^2$ on a dry basis. Such subbing layers may, for example, be coated and dried using processes similar to those described for applying under-layers and image-receiving layers.

In some embodiments, the one or more subbing layers may comprise gelatin, such as, for example, Regular Type IV bovine gelatin, alkali-treated gelatin, acid-treated gelatin, phthalate-modified gelatin, vinyl polymer-modified gelatin, acetylated gelatin, deionized gelatin, and the like.

Such subbing layers may comprise one or more polymers. In some embodiments, such polymers may comprise polymers of monomers comprising polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. In some embodiments, materials used in adhesion-promoting layers comprise polymers of one or more monomers containing a chloride group such as vinylidene chloride. In some embodiments, subbing layers may comprise one or more polymers comprising one or more polymeric matting agents. Such polymeric matting agents are described in U.S. Pat. No. 6,555,301 to Smith et al., which is hereby incorporated by reference in its entirety.

Such subbing layers may comprise one of more hardening agents or crosslinking agents. Such hardening agents are sometimes referred to as hardeners. In some embodiments, such hardening agents may include, for example, 1,2-bis(vinylsulfonylacetamido)ethane, bis(vinylsulfonyl)methane, bis(vinylsulfonylmethyl)ether, bis(vinylsulfonylethyl)ether, 1,3-bis(vinylsulfonyl)propane, 1,3-bis(vinylsulfonyl)-2-hydroxypropane, 1,1,-bis(vinylsulfonyl)ethylbenzenesulfonate sodium salt, 1,1,1-tris(vinylsulfonyl)ethane, tetrakis(vinylsulfonyl)methane, tris(acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardening agents such as halogen-substituted aldehyde acids, vinyl sulfones containing other hardening functional groups, 2,3-dihydroxy-1,4-dioxane, potassium chrome alum, polymeric hardening agents such as polymeric aldehydes, polymeric vinylsulfones, polymeric blocked vinyl sulfones and polymeric active halogens.

Such subbing layers may comprise one or more surfactants. In some embodiments, such surfactants may include, for example, anionic surface active agents such as alkali metal or ammonium salts of alcohol sulfuric acid of 8 to 18 carbon atoms; ethanolamine lauryl sulfate; ethylaminolauryl sulfate; alkali metal and ammonium salts of paraffin oil; alkali metal salts of aromatic sulfonic acid such as dodecane-1-sulfonic acid, octadiene-1-sulfonic acid or the like; alkali metal salts such as sodium isopropylbenzene-sulfate, sodium isobutylnaphthalenesulfate or the like; and alkali metal or ammonium salts of esters of sulfonated dicarboxylic acid such as sodium dioctylsulfosuccinate, disodium dioctadecylsulfosuccinate or the like; nonionic surface active agents such as saponin, sorbitan alkyl esters, polyethylene oxides, polyoxyethylene alkyl ethers or the like; cationic surface active agents such as octadecyl ammonium chloride, trimethyldosecyl ammonium chloride or the like; and high molecular surface active agents other than those above mentioned such as polyvinyl alcohol, partially saponified vinyl acetates, maleic acid containing copolymers, or the like.

Such subbing layers may be coated from, for example, aqueous mixes. In some embodiments, a portion of the water in such mixes may be replaced by one or more water miscible solvents. Such solvents may include, for example, ketones such as acetone or methyl ethyl ketone, alcohols such as ethanol, methanol, isopropanol, n-propanol, and butanol, and the like.

Polymeric Matting Agents

In some embodiments, one or more subbing layers may comprise one or more polymers comprising one or more polymeric matting agents. Such polymeric matting agents are described in U.S. Pat. No. 6,555,301 to Smith et al., which is hereby incorporated by reference in its entirety. Polymeric matting agents may have an average particle sizes from, for example, about 1.2 to about 3 micrometers and glass transition temperatures of, for example, at least about 135° C. or of at least about 150° C., as indicated by, for example, the onset in the change of heat capacity as measured by differential scanning calorimetry at a scan rate of 20° C./min. In some embodiments, polymeric matting agents may comprise copolymers of (A) recurring units derived from one or more polyfunctional ethylenically unsaturated polymerizable acrylates or methacrylates, and (B) recurring units derived from one or more monofunctional ethylenically unsaturated polymerizable acrylates or methacrylates having only one polymerizable site. Such copolymers may have compositions comprising, for example, from about 10 to about 30 wt % of (A) recurring units and from about 70 to about 90 wt % of (B) recurring units. Such copolymers may have compositions comprising at least about 5 wt % (A) recurring units, or at least about 10 wt % (A) recurring units, or up to about 30 wt % (A) recurring units, or up to about 50 wt % (A) recurring units. Such copolymers may have compositions comprising at least about 50 wt % (B) recurring units, or at least about 70 wt % (B) recurring units, or up to about 90 wt % (B) recurring units or up to about 95 wt % (B) recurring units.

Ethylenically unsaturated monomers represented by (A) include ethylenically unsaturated polymerizable compounds that have two or more functional groups that can be polymerized or reacted to form crosslinking sites within the polymer matrix. Thus, such monomers are considered "polyfunctional" with respect to the moieties used for polymerization and crosslinking. Representative monomers of this type include but are not limited to, aromatic divinyl compounds (such as divinylbenzene, divinylnaphthalene, and derivatives thereof), diethylene carboxylate esters (that is, acrylate and methacrylates) and amides (such as ethylene glycol dimethacrylate, diethylene glycol dimethacrylate, triethylene glycol dimethacrylate, ethylene glycol diacrylate, diethylene glycol diacrylate, 1,6-hexanediol dimethacrylate, 1,6-hexanediol diacrylate, pentaerythritol tetraacrylate, neopentyl glycol dimethacrylate, allyl methacrylate, allyl acrylate, butenyl acrylate, undecenyl methacrylate, 1,4-butanediol dimethacrylate, trimethylol propane trimethacrylate, trimethylol propane triacylate, 1,3-dibutanediol dimethacrylate, methylene-bisacrylamide, and hexamethylene-bisacrylamide), dienes (such as butadiene and isoprene), other divinyl compounds such as divinyl sulfide and divinyl sulfone compounds, and other compounds that would be readily apparent to one skilled in the art. Two or more of these monomers can be used to prepare matting agents. The polyfunctional acrylates and methacrylates described above are preferred in the practice of this invention. Ethylene glycol dimethacrylate, 1,6-hexanediol dimethacrylate, 1,6-hexanediol diacrylate, trimethylol propane trimethacrylate, and trimethylol propane triacrylate are particularly preferred. Ethylene glycol dimethacrylate is most preferred.

Ethylenically unsaturated monomers represented by (B) include polymerizable compounds that only one functional group that can be polymerized or reacted to form crosslinking sites within the polymer matrix. These include any other known monomer that can be polymerized in suspension polymerization with the monomers defined by the (A) recurring units. Such monomers include but are not limited to, ethylenically unsaturated hydrocarbons (such as ethylene, propylene, l-butene, isobutene, styrene, α-methylstyrene, m-chloromethylstyrene, vinyl toluene, vinyl naphthalene, p-methoxystyrene, and hydroxymethylstyrene), ethylenically unsaturated esters of carboxylic acids (such as vinyl acetate, vinyl propionate, vinyl benzoate, vinyl cinnamate, and vinyl butyrate), esters of ethylenically unsaturated mono- or dicarboxylic acid amides (such as acrylamide, methacrylamide, N-methylacrylamide, N-ethylacrylamide, N,N-dimethylacrylamide, N-n-butylacrylamide, N-t-butylacrylamide, itaconic acid diamide, acrylamido-2,2-dimethylpropanesulfonic acid, N-isopropylacrylamide, N-acryloylmorpholine, and N-acryloylpiperidine), monoethylenically unsaturated dicarboxylic acids and their salts (such as acrylic acid, methacrylic acid, itaconic acid, and their salts), monoethylenically unsaturated compounds such as acrylonitrile and methacrylonitrile, vinyl halides (such as vinyl chloride, vinyl fluoride, and vinyl bromide), vinyl ethers (such as vinyl methyl ether, vinyl isobutyl ether, and vinyl ethyl ether), vinyl ketones (such as vinyl methyl ketone, vinyl hexyl ketone, and methyl isopropenyl ketone), acrolein, vinylidene halides (such as vinylidene chloride and vinylidene chlorofluoride), N-vinyl compounds (such as N-vinyl pyrrolidone, N-vinyl pyrrole, N-vinyl carbazole, and N-vinyl indole), and alkyl or aryl esters, amides, and nitriles (that is acrylates and methacrylates, such as methyl methacrylate, methyl acrylate, ethyl methacrylate, ethyl acrylate, n-butyl methacrylate, isobutyl methacrylate, 2-hydroxyethyl acrylate, 2-hydroxyethyl methacrylate, hexyl acrylate, hexyl methacrylate, 2-ethylhexyl acrylate, nonyl methacrylate, benzyl methacrylate, 2-hydroxypropyl methacrylate, and amides and nitriles of the same acids), and other compounds that would be understood to one skilled in the art. Mixtures of such monomers can also be used. Acrylates and methacrylates are preferred monomers for obtaining the (B) recurring units. Methyl methacrylate, isobutyl methacrylate, and methyl acrylate are particularly preferred and methyl methacrylate is most preferred.

In some embodiments, polymeric matting agents are prepared using one or more polyfunctional acrylates or methacrylates and one or more monofunctional acrylates or methacrylates. Representative useful polymers are as follows (having weight ratios within the previously described ranges): poly(methyl methacrylate-co-ethylene glycol dimethacrylate), poly(methyl methacrylate-co-1,6-hexanediol diacrylate), poly(methyl acrylate-co-trimethylol propane triacrylate), poly(isobutyl methacrylate-co-ethylene glycol dimethacrylate), and poly(methyl acrylate-co-1,6-hexanediol diacrylate).

Under-Layer Coating Mix

Under-layers may be formed by applying at least one under-layer coating mix to one or more of the subbing layers, primer layers, or transparent substrates. The under-layer formed may, in some cases, comprise at least about 2.9 g/m$^2$ solids on a dry basis, or at least about 3.0 g/m$^2$ solids on a dry basis, or at least about 3.5 g/m$^2$ solids on a dry basis, or at least about 4.0 g/m$^2$ solids on a dry basis, or at least about 4.2 g/m$^2$ solids on a dry basis, or at least about 5.0 g/m$^2$ solids on a dry basis, or at least about 5.8 g/m$^2$ solids on a dry basis. The under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 g/m$^2$. In at least some embodiments, the ratio of the at least one borate or borate derivative to the gelatin may be between about 20:80 and about 1:1 by weight, or the ratio may be about 0.45:1 by weight. In some embodiments, the under-layer coating mix may comprise, for example, at least about 4 wt % solids, or at least about 9.2 wt % solids. The under-layer coating mix may comprise, for example, about 15 wt % solids.

The under-layer coating mix may also comprise a thickener. Examples of suitable thickeners include, for example, anionic polymers, such as sodium polystyrene sulfonate, other salts of polystyrene sulfonate, salts of copolymers comprising styrene sulfonate repeat units, anionically modified polyvinyl alcohols, and the like.

In some embodiments, the under-layer coating mix may optionally further comprise other components, such as surfactants, such as, for example, nonyl phenol, glycidyl polyether, fluoroacrylic alcohol substituted polyethylenes; hydroxyl-terminated fluorinated polyethers; and non-ionic fluorosurfactants. In some embodiments, such a surfactant may be used in amount from about 0.001 to about 0.20 g/m$^2$, as measured in the under-layer. These and other optional mix components will be understood by those skilled in the art.

Image-Receiving Layer Coating Mix

Image-receiving layers may be formed by applying at least one image-receiving layer coating mix to one or more under-layer coatings. The image-receiving layer formed may, in some cases, comprise at least about 40 g/m$^2$ solids on a dry basis, or at least about 41.3 g/m$^2$ solids on a dry basis, or at least about 45 g/m$^2$ solids on a dry basis, or at least about 49 g/m$^2$ solids on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

In some embodiments, one or more eductor-mixers may be used to prepare mixtures comprising inorganic particles, as described in U.S. provisional patent application 61/388,784, "TRANSPARENT INK-JET RECORDING FILMS, COMPOSITIONS, AND METHODS," by Ruzinsky et al, filed Oct. 1, 2010, which is hereby incorporated by reference in its entirety.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

The image-receiving coating layer mix may also comprise one or more surfactants such as, for example, nonyl phenol, glycidyl polyether fluoroacrylic alcohol substituted polyethylenes; hydroxyl-terminated fluorinated polyethers; and nonionic fluorosurfactants. In some embodiments, such a surfactant may be used in amount of, for example, about 1.5 g/m$^2$, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Back-Coat Layer Coating Mix

Back-coat layers may be formed by applying at least one back-coat coating mix to one or more subbing layers, primer layers, or transparent substrates. In some embodiments, the at least one back-coat layer coating mix may be applied on the side of the one or more transparent substrates opposite to that which the under-layer coating mix or image receiving layer coating mix is applied.

The at least one back-coat layer coating mix may comprise gelatin. In at least some embodiments, the gelatin may be a Regular Type IV bovine gelatin.

The at least one back-coat layer coating mix may further comprise other hydrophilic colloids, such as, for example, dextran, gum arabic, zein, casein, pectin, collagen derivatives, collodion, agar-agar, arrowroot, albumin, and the like. Other examples of hydrophilic colloids are water-soluble polyvinyl compounds such as polyvinyl alcohol, polyacrylamides, polymethacrylamide, poly(N,N-dimethacrylamide), poly(N-isopropylacrylamide), poly(vinylpyrrolidone), poly(vinyl acetate), polyalkylene oxides such as polyethylene oxide, poly(6,2-ethyloxazolines), polystyrene sulfonate, polysaccharides, or cellulose derivatives such as carboxymethyl cellulose, hydroxyethyl cellulose, their sodium salts, and the like.

In at least some embodiments, the at least one back-coat layer may further comprise at least one other hydrophilic colloid comprising at least one of sodium carboxymethylate casein or a polyacrylamide. In some case, the at least some cases, the at least one back-coat layer may comprise both sodium carboxymethylate casein and a polyacrylamide.

In some cases, the at least one back-coat layer may further comprise at least one polysiloxane. Such compounds are sometimes referred to as silicones, because of the presence of silicon-oxygen bonds in their backbone chain.

The at least one back-coat layer coating mix may further comprise at least one core-shell particle comprising at least one thermoplastic polymer and at least one colloidal inorganic particle, where at least a portion of the at least one thermoplastic is coated with the at least one colloidal inorganic particle. The at least one thermoplastic polymer may be referred to as the core material and the at least one colloidal inorganic particle may be referred to as the shell material. Such core-shell particles may be, for example, from about 0.5 μm to about 10 μm in diameter. The ratio of thermoplastic polymers to the colloidal inorganic particles may be from about 5:1 to about 99:1, or from about 15:1 to about 50:1. Examples of suitable thermoplastic polymers include, for example, polyesters, acrylic polymers, styrenic polymers, and the like. Such thermoplastic polymers may have softening points, as measured by ASTM E28 ring and ball method, of at least about 50° C., or from about 50° C. to about 120° C. In some embodiments, the at least one thermoplastic polymer comprises a styrene allyl alcohol copolymer. Examples of suitable colloidal inorganic particles include, for example, colloidal silicas, modified colloidal silicas, colloidal aluminas, and the like. Such colloidal inorganic particles may be, for example, from about 5 nm to about 100 nm in diameter. Further examples of suitable core-shell particles are described in U.S. Pat. No. 6,457,824 to Wexler, which is hereby incorporated by reference in its entirety.

In at least some embodiments, the at least one core-shell particle comprises a dry coverage of at least about 100 mg/m$^2$. In some cases, the at least one core-shell polymer may comprise a dry coverage of at least about 120 mg/m$^2$, such as, for example, a dry coverage of at least about 120 mg/m$^2$ and less than about 200 mg/m$^2$. Or the at least one core-shell polymer may, for example, comprise a dry coverage of at least about 100 mg/m$^2$ and less than about 500 mg/m$^2$, or a dry coverage of at least about 100 mg/m$^2$ and less than about 1000 mg/m$^2$.

The at least one back-coat layer coating mix may optionally further comprise colloidal inorganic particles in addition to any that may be supplied as a coating of a thermoplastic polymer.

The at least one back-coat layer coating mix may further comprise at least one hardening agent. In some embodiments, the at least one hardening agent may be added to the coating mix as the coating mix is being applied to the substrate, for example, by adding the at least one hardening agent upstream of an in-line mixer located in a line downstream of the back-coat coating mix tank. In some embodiments, such hardening agents may include, for example, 1,2-bis(vinylsulfonylacetamido)ethane, bis(vinylsulfonyl)methane, bis(vinylsulfonylmethyl)ether, bis(vinylsulfonylethyl)ether, 1,3-bis(vinylsulfonyl)propane, 1,3-bis(vinylsulfonyl)-2-hydroxypropane, 1,1,-bis(vinylsulfonyl)

ethylbenzenesulfonate sodium salt, 1,1,1-tris(vinylsulfonyl) ethane, tetrakis(vinylsulfonyl)methane, tris(acrylamido) hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardening agents such as halogen-substituted aldehyde acids, vinyl sulfones containing other hardening functional groups, 2,3-dihydroxy-1,4-dioxane, potassium chrome alum, polymeric hardening agents such as polymeric aldehydes, polymeric vinylsulfones, polymeric blocked vinyl sulfones and polymeric active halogens. In some embodiments, the at least one hardening agent may comprise a vinylsulfonyl compound, such as, for example bis(vinylsulfonyl)methane, 1,2-bis(vinylsulfonyl)ethane, 1,1-bis(vinylsulfonyl)ethane, 2,2-bis(vinylsulfonyl)propane, 1,1-bis(vinylsulfonyl)propane, 1,3-bis(vinylsulfonyl)propane, 1,4-bis(vinylsulfonyl)butane, 1,5-bis(vinylsulfonyl)pentane, 1,6-bis(vinylsulfonyl)hexane, and the like.

In at least some embodiments, the at least one back-coat layer may comprise at least one first layer and at least one second layer, where the at least one first layer is disposed between the at least one second layer and the second surface of the substrate. The at least one first layer may, for example, comprise gelatin and at least one hardening agent, such as, for example, bis(vinylsulfonyl)methane. The at least one second layer may, for example, comprise gelatin and the at least one core-shell particle. In some cases, the at least one second layer further comprises at least one other hydrophilic colloid comprising at least one of sodium carboyxmethylate casein or a polyacrylamide, or, for example, the at least one second layer may comprise both sodium carboxymethylate casein and a polyacrylamide. In at least some cases, the at least one second layer further comprises at least one polysiloxane. In some cases, the at least one second layer further comprises at least one second hardening agent, such as, for example, chrome alum.

In some embodiments, the at least one back-coat layer coating mix may optionally further comprise at least one surfactant, such as, for example, one or more anionic surfactants, one or more cationic surfactants, one or more fluorosurfactants, one or more nonionic surfactants, and the like. These and other optional mix components will be understood by those skilled in the art.

Coating

The coated layers, such as, for example, primer layers, subbing layers, under-layers, image-receiving layers, back-coat layers, and the like, may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

The at least one back-coat layer may be coated from at least one mix onto the opposite side of the transparent substrate from the side on which the at least one under-layer coating mix and the at least one image-receiving layer coating mix are coated. In at least some embodiments, two or more mixes may be combined and mixed using an in-line mixer to form the coating that is applied to the substrate. The at least one back-coat layer may be applied simultaneously with the application of either of the at least one under-layer or at least one image receiving layer, or may be coated independently of the application of the other layers.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, December 1989, pp. 1007-08, (available from Research Disclosure, 145 Main St., Ossining, N.Y., 10562, http://www.researchdisclosure.com).

Drying

Coated layers, such as, for example primer layers, subbing layers, under-layers, image-receiving layers, back-coat layers, and the like, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure.com). In some embodiments, coating layers may be dried as they travel past one or more perforated plates through which a gas, such as, for example, air or nitrogen, passes. Such an impingement air dryer is described in U.S. Pat. No. 4,365,423 to After et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

EXEMPLARY EMBODIMENTS

U.S. Provisional Application No. 61/405,671, filed Oct. 22, 2010, entitled TRANSPARENT INK-JET RECORDING FILMS, COMPOSITIONS, AND METHODS, which is hereby incorporated by reference in its entirety, disclosed the following ten non-limiting exemplary embodiments:

A. A transparent ink-jet recording film comprising:

a transparent substrate comprising a polyester, said substrate comprising at least a first surface and a second surface;

at least one under-layer disposed on said first surface, said at least one under-layer comprising gelatin and at least one borate or borate derivative;

at least one image-receiving layer disposed on said at least one under-layer, said at least one image-receiving layer comprising at least one water soluble or water dispersible polymer and at least one inorganic particle, said at least one water soluble or water dispersible polymer comprising at least one hydroxyl group; and at least one back-coat layer disposed on said second surface, said at least one back-coat layer comprising gelatin, at least one other hydrophilic colloid, and at least one core-shell particle comprising at least one thermoplastic polymer.

B. The transparent ink-jet recording film according to embodiment A, wherein said at least one other hydrophilic colloid comprises one or more of sodium carboxymethylate casein and a polyacrylamide.

C. The transparent ink-jet recording film according to embodiment A, wherein said at least one other hydrophilic colloid comprises sodium carboxymethylate casein and a polyacrylamide.

D. The transparent ink-jet recording film according to embodiment A, wherein the at least one thermoplastic polymer comprises a styrene allyl alcohol copolymer.

E. The transparent ink-jet recording film according to embodiment A, wherein the at least one core-shell particle comprises a styrene allyl alcohol copolymer core and a colloidal silica shell.

F. The transparent ink-jet recording film according to embodiment A, wherein the at least one back-coat layer further comprise at least one hardening agent.

G. The transparent ink-jet recording film according to embodiment F, wherein the at least one hardening agent comprises at least one of bis(vinylsulfonyl)methane or chrome alum.

H. The transparent ink-jet recording film according to embodiment A, wherein the at least one back-coat layer comprises a first layer and a second layer, said first layer being disposed between the second layer and the second surface of the substrate, wherein the first layer comprises gelatin and at least one first hardener, and the second layer comprises gelatin, the at least one other hydrophilic colloid, the at least one core-shell particle, and at least one second hardener.

J. The transparent ink-jet recording film according to embodiment H, wherein the at least one first hardener comprises bis(vinylsulfonyl)methane.

K. The transparent ink-jet recording film according to embodiment H, wherein the at least one second hardener comprises chrome alum.

U.S. Provisional Application No. 61/415,954, filed Nov. 22, 2010, entitled TRANSPARENT INK-JET RECORDING FILMS, COMPOSITIONS, AND METHODS, which is hereby incorporated by reference in its entirety, disclosed the following 15 non-limiting exemplary embodiments:

L. A transparent ink-jet recording film comprising:

a transparent substrate comprising a polyester, said substrate comprising at least a first surface and a second surface;

at least one first subbing layer disposed on the first surface of the transparent substrate, said at least one first subbing layer comprising gelatin and at least one first polymeric matting agent:

at least one under-layer disposed on the at least one first subbing layer, said at least one under-layer comprising gelatin and at least one borate or borate derivative;

at least one image-receiving layer disposed on the at least one under-layer, said at least one image-receiving layer comprising at least one inorganic particle and at least one water soluble or water dispersible polymer comprising at least one hydroxyl group; and at least one back-coat layer disposed on said second surface of the transparent substrate, said at least one back-coat layer comprising gelatin and at least one core-shell particle comprising at least one thermoplastic polymer.

M. The transparent ink-jet recording film according to embodiment L, further comprising at least one second subbing layer disposed between the second surface of the substrate and the at least one back-coat layer, said at least one second subbing layer comprising gelatin and at least one second polymeric matting agent.

N. The transparent ink-jet recording film according to embodiment M, wherein the at least one second polymeric matting agent comprises poly(methyl methacrylate-co-ethylene glycol dimethacrylate).

P. The transparent ink-jet recording film according to embodiment M, further comprising at least one primer layer disposed between the second surface of the substrate and the at least one second subbing layer, said at least one primer layer comprising at least one latex polymer and at least one adhesion promoter.

Q. The transparent ink-jet recording film according to embodiment L, further comprising at least one primer layer disposed between the first surface of the transparent substrate and the at least one first subbing layer, said at least one primer layer comprising at least one latex polymer and at least one adhesion promoter.

R. The transparent ink-jet recording film according to embodiments P or Q, wherein the at least one latex polymer comprises poly(vinylidene chloride-co-methyl acrylate-co-itaconic acid)

S. The transparent ink-jet recording film according to embodiments P or Q, wherein the at least one adhesion promoter comprises resorcinol.

T. The transparent ink-jet recording film according to embodiment L, wherein the at least one back-coat layer comprises a first layer and a second layer, said first layer being disposed between said second layer and the second surface of the transparent substrate, wherein said first layer comprises gelatin and at least one hardener, and said second layer comprises gelatin and the at least one core-shell particle.

U. The transparent ink-jet recording film according to embodiment T, wherein the at least one hardener comprises bis(vinylsulfonyl)methane.

V. The transparent ink-jet recording film according to embodiment L, wherein the at least one first polymeric matting agent comprises poly(methyl methacrylate-co-ethylene glycol dimethacrylate).

W. The transparent ink-jet recording film according to embodiment L, wherein the at least one borate or borate derivative comprises at least one hydrate of sodium tetraborate.

X. The transparent ink-jet recording film according to embodiment L, wherein the at least one borate or borate derivative comprises sodium tetraborate decahydrate.

Y. The transparent ink-jet recording film according to embodiment L, wherein the at least one inorganic particle comprises boehmite alumina.

Z. The transparent ink-jet recording film according to embodiment L, wherein the at least one water soluble or water dispersible polymer comprises poly(vinyl alcohol).

AA. The transparent ink-jet recording film according to embodiment L, wherein the at least one core-shell particle comprises a styrene allyl alcohol copolymer core and a colloidal silica shell.

U.S. Provisional Application No. 61/490,619, filed May 27, 2011, entitled TRANSPARENT INK-JET RECORDING FILMS, COMPOSITIONS, AND METHODS, which is hereby incorporated by reference in its entirety, disclosed the following 16 non-limiting exemplary embodiments:

AB. A transparent ink-jet recording film comprising:

a transparent substrate comprising a polyester, said substrate comprising at least a first surface and a second surface;

at least one under-layer disposed on said first surface, said at least one under-layer comprising gelatin and at least one borate or borate derivative;

at least one image-receiving layer disposed on said at least one under-layer, said at least one image-receiving layer comprising at least one water soluble or water dispersible polymer and at least one inorganic particle, said at least one water soluble or water dispersible polymer comprising at least one hydroxyl group; and at least one back-coat layer disposed on said second surface, said at least one back-coat layer comprising gelatin and at least one core-shell particle comprising at least one thermoplastic polymer, wherein said at least one core-shell particle comprises a dry coverage of at least about 100 mg/m$^2$.

AC. The transparent ink-jet recording film according to embodiment AB, wherein the at least one core-shell particle comprises a styrene allyl alcohol polymer core and a colloidal silica shell.

AD. The transparent ink-jet recording film according to embodiment AB, wherein the at least one core-shell particle comprises a dry coverage of at least about 120 mg/m$^2$.

AE. The transparent ink-jet recording film according to embodiment AB, wherein the at least one back-coat layer further comprises at least one other hydrophilic colloid comprising at least one of sodium carboxymethylate casein or a polyacrylamide.

AF. The transparent ink-jet recording film according to embodiment AB, wherein the at least one back-coat layer further comprises sodium carboxymethylate casein and at least one polyacrylamide.

AG. The transparent ink-jet recording film according to embodiment AB, wherein the at least one back-coat layer further comprises at least one polysiloxane.

AH. The transparent ink-jet recording film according to embodiment AB, wherein the at least one back-coat layer comprises at least one first layer and at least one second layer, said at least one first layer being disposed between said at least one second layer and the second surface of the transparent substrate, and wherein said at least one first layer comprises gelatin and at least one hardener, and said at least one second layer comprises gelatin and the at least one core-shell particle.

AJ. The transparent ink-jet recording film according to embodiment AH, wherein the at least one second layer further comprises at least one other hydrophilic colloid comprising at least one of sodium carboxymethylate casein or a polyacrylamide.

AK. The transparent ink-jet recording film according to embodiment AH, wherein the at least one second layer further comprises sodium carboxymethylate casein and at least one polyacrylamide.

AL. The transparent ink-jet recording film according to embodiment AH, wherein the at least one second layer further comprises at least one polysiloxane.

AM. The transparent ink-jet recording film according to embodiment AH, wherein the at least one hardener comprises bis(vinylsulfonyl)methane.

AN. The transparent ink-jet recording film according to embodiment AB, wherein the at least one inorganic particle comprises boehmite alumina.

AP. The transparent ink-jet recording film according to embodiment AB, wherein the at least one borate or borate derivative comprises at least one hydrate of sodium tetraborate.

AQ. The transparent ink-jet recording film according to embodiment AB, wherein the at least one water soluble or water dispersible polymer comprises poly(vinyl alcohol).

AR. The transparent ink-jet recording film according to embodiment AB comprising an ink transfer measurement of zero squares transferred when subjected to 5.7 psi pressure and 85% relative humidity for seven days, wherein said ink transfer measurement is based on 390¼-in×¼-in grid squares.

AS. The transparent ink-jet recording film according to embodiment AB comprising an ink transfer measurement of zero squares transferred when subjected to 0.081 psi pressure and 86% relative humidity for four days, wherein said ink transfer measurement is based on 390⅛-in×⅛-in grid squares.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

Gelatin is a Regular Type IV bovine gelatin. It is available as Catalog No. 8256786 from Eastman Gelatine Corporation, Peabody, Mass.

KATHON® LX is a microbiocide. It is available from Dow Chemical.

Polyethylene terephthalate webs were coated on both front and back surfaces with primer and subbing layers, using the procedure of Example 5, below. These are referred to as "primed and subbed" webs in the other examples.

Silica coated polymer beads were prepared using SAA 1200 styrene allyl alcohol copolymer beads (Lyondell Chemical) and LUDOX® 6.7 micron colloidal silica particles (DuPont), as described in U.S. Pat. Nos. 4,833,060, 5,354,799, and 6,457,824, each of which is hereby incorporated by reference in its entirety.

Surfactant 10G is an aqueous solution of nonyl phenol, glycidyl polyether. It is available from Dixie Chemical Co., Houston, Tex.

VERSA-TL® 502 is a sulfonated polystyrene (1,000,000 molecular weight). It is available from AkzoNobel.

Methods

Evaluation of Samples for Curl 30.5 cm×7.6 cm coated film samples were evaluated for curl. Three sets of environmental testing conditions were used: (1) 23° C. at 52% relative humidity, (2) 20° C. at 86% relative humidity, and (3) 22° C. at 24% relative humidity. Each of the films was placed on a horizontal surface, image-receiving layer side up, and allowed to acclimate to the environmental testing conditions for 24 hrs. The deflection of each the four corners of each film from the horizontal surface was measured, averaged, and recorded.

Evaluation of Samples for Drying

Coated films were imaged with an EPSON® 7900 ink-jet printer (Examples 1-4) or with an EPSON® 4900 ink-jet printer (Examples 5-21) using a Wasatch Raster Image Processor (RIP). A grey scale image was created by a combination of photo black, light black, light black, magenta, light magenta, cyan, light cyan, and yellow EPSON® inks that were supplied with the printer. Samples were printed with a 17-step grey scale wedge having a maximum optical density of at least 2.8. Films were evaluated under moderate humidity (50-60% relative humidity) and high humidity (80-90% relative humidity) conditions. Coated films were equilibrated at these conditions for at least 16 hrs prior to printing.

Immediately after the film exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. In general, the higher number wedges dried before the lowest number wedges.

Measures of wetness were constructed by taking the largest wedge number for the set of completely wet wedges and adding to it the fractional wetness of the adjacent wedge with the next higher wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Evaluation of Samples for Ink Transfer

Coated films were equilibrated at about 85% relative humidity for at least 16 hrs, and then were imaged at about 85% relative humidity with an EPSON® 4900 ink-jet printer using an image having a 4-in×7.76-in block having an optical density of at least 2.8. Immediately after printing, the films were removed from the printer and laid flat, receptor side up. Coated films were placed over the printed films, so that the receptor sides of the printed films contacted the backsides of the coated films covering them. Weights were applied over the covering films, so as to apply a pressure of either about 0.081 psi (560 Pa) or about 5.7 psi (39 kPa) to the films. The films were left under pressure for 24 hrs to 7 days at about 85% relative humidity, after which the weights were removed. The films were carefully separated and inspected for ink-transfer from the receptor sides of the printed films to the backcoat sides of the covering films, by placing a transparent 390-square grid over the printed films and counting the number of ¼-in×¼-in squares having low print density ("squares transferred").

Evaluation of Samples for Backcoat Layer Adhesion

In cases where humidity was measured and controlled, films were evaluated under moderate humidity (50-60% relative humidity), high humidity (80-90% relative humidity) conditions. Where humidity is not reported, films were evaluated under ambient conditions. In all cases, films were equilibrated for at least 16 hrs prior to initiating adhesion testing.

Adhesion of the backcoat layers of the coated films was evaluated by scribing a cross-hatched area on each film with a razor blade and gently removing the debris with a lint-free cotton pad. Adhesive tape (#610 semi-transparent pressure-sensitive tape from 3M Company, St. Paul, Minn.) was then applied to the crosshatched area and smoothed with a rubber roller until there were no air bubbles between the tape and the coated film. The tape was then rapidly peeled off. The appearance of the coated film was given a score on a 0 to 5 scale: 5=edges of scribed cuts completely smooth; 4=flakes of coating detached at some intersections of scribed lines, with less than about 5% of the test area being affected; 3=flakes of coating detached along some edges and at some intersections of scribed lines, with about 5 to 15% of the test area being affected; 2=flakes of coating detached along some edges of scribed lines and on parts of the squares, with about 15 to 35% of the test area being affected; 1=coating detached along the edges of scribed lines in large ribbons, with more than about 35% of the test area being affected; 0=coating completely removed.

Evaluation of Samples for Backcoat Layer Roughness

Surface roughness of the backcoat layers of the coated films were measured using a Bekk Smoothness Tester Model BK131/ED that is available from Büchel van der Korput, Nederland BV (Veendaal, Holland). This instrument reports the elapsed time required to achieve a particular change in air pressure during evacuation of the air above a coated film sample. Because the air above a rough surface can be evacuated faster than the air over a smooth surface, smaller Bekk times correspond to rougher surfaces.

Example 1

Preparation of Polyvinyl Alcohol/Silica Back-Layer Coating Mix

To a mixing vessel, 2516 g of a 15 wt % aqueous solution of CELVOL® 203 was introduced and agitated at room temperature. To this mix, 418.8 g of demineralized water was added and agitated for 10 min. 65.2 g of a 5.6 wt % aqueous solution of 8 micron colloidal silica was added to this agitated mix.

This mix was then diluted to 90% strength with the addition of 10% demineralized water.

Preparation of Back-Layer Coated Web

The back-layer coating mix was heated to 40° C. and applied continuously to a room temperature primed and subbed polyethylene terephthalate web, which was moving at a speed of 27 ft/min. The back-layer coating mix feed rate was either 73.2 g/min or 81.9 g/min, resulting in dry back-layer coating weights of 11.3 g/m$^2$ or 12.1 g/m$^2$, respectively.

Preparation of Gelatin Under-Layer Coating Mix

To a mixing vessel, 5155 g of demineralized water was introduced. 252 g of gelatin was added to the agitated vessel and allowed to swell. This mix was heated to 60° C. and held until the gelatin was fully dissolved. The mix was then cooled to 50° C. To this mix, 113.4 g of borax (sodium tetraborate decahydrate) was added and mixed until the borax was fully dissolved. To this mix, 393.8 g of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 85.9 g of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The weight ratio of borax to gelatin in the resulting under-layer coating mix was 0.45:1.

Preparation of Under-Layer Coated Web

The under-layer coating mix was heated to 40° C. and applied continuously to the back-layer coated primed and subbed polyethylene terephthalate web, which was moving at a speed of 30.0 ft/min. This coating was applied to the side opposite that to which the back-layer coating had been applied. The under-layer coating mix feed rate was 61.0 g/min or 89.5 g/min, resulting in dry under-layer coating weights of 3.9 g/m$^2$ or 5.9 g/m$^2$, respectively. The coated web was dried continuously by moving past perforated plates through which room temperature air flowed. The pressure drop across the perforated plates was in the range of 0.8 to 3 in $H_2O$. The air dew point was in the range of 7 to 13° C.

Preparation of Alumina Mix

An alumina mix was prepared at room temperature by mixing 324 g of a 22 wt % aqueous solution of nitric acid and 8076 g of demineralized water. To this mix, 3600 g of alumina powder (DISPERAL® HP-14) was added over 30 min. The pH of the mix was adjusted to 2.17 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 2801 g of a 10 wt % aqueous solution of poly(vinyl alcohol) (CELVOL® 540) into a mixing vessel and agitating. To this mix, 10739 g of the alumina mix and 240 g of a 10 wt % aqueous solution of nonyl phenol, glycidyl polyether (Surfactant 10G) was added.

This mix was then diluted to 85% strength by adding 15% demineralized water. The mix was cooled to room temperature and held for gas bubble disengagement prior to use.

Preparation of Image-Receiving Layer Coated Film

The image-coating mix was heated to 40° C. and coated onto the under-layer coated surface of a room temperature primed and subbed polyethylene terephthalate web, which was moving at a speed of 30.0 ft/min. The image-receiving layer coating mix feed rate was 159.7 g/min or 174.8 g/min, resulting in dry image-receiving layer coating weights of 50.5 $g/m^2$ or 55.6 $g/m^2$, respectively. The coated film was dried continuously by moving past perforated plates through which room temperature air flowed. The pressure drop across the perforated plates was in the range of 0.8 to 3 in $H_2O$. The air dew point was in the range of 7 to 13° C.

Evaluation of Samples for Curl

Coated film samples were evaluated for curl. The results are summarized in Table I. A linear regression model was prepared from the data:

$$\textit{Curl}, \text{mm} = +0.10 \times \text{Image-receiving layer coating weight, } g/m^2 + 0.26 \times \text{Under-layer coating weight, } g/m^2 + 0.031 \times \text{Relative humidity, percent} - 7$$

These results suggest that increased image-receiving layer coating weights and increased under-layer coating weights were associated with increasing curl.

Evaluation of Samples for Drying

Coated films were evaluated for drying performance after being imaged with an EPSON® 7900 ink-jet printer using a Wasatch Raster Image Processor (RIP). Wetness results are summarized in Table I. A linear regression model was prepared from the data:

$$\text{Wetness, } \% = -0.30 \times \text{Image-receiving layer coating weight, } g/m^2 - 0.8 \times \text{Under-layer coating weight, } g/m^2 + 21$$

These results suggest that increased image-receiving layer coating weights and increased under-layer coating weights were associated with decreased wetness.

Taken together with the curl results, these results suggest that, all other things begin equal, any decrease in wetness that would be expected to occur from increasing image-receiving layer coating weights or increasing under-layer coating weights would be expected to be accompanied by an increase in curl.

Evaluation of Samples for Back-Coat Adhesion

Adhesion of the back-coat layer of each coated film was evaluated. The results are summarized in Table I. Adhesion scores ranged from 2.3 to 4.3.

Example 2

Preparation of Gelatin/Polymer Matte Back-Layer Coating Mix

To a mixing vessel, 4166 parts by weight of demineralized water, 2902 parts by weight of gelatin, and 29 parts by weight of silica coated polymer beads were added. The mix was agitated at room temperature for 15 min, after which the temperature of the mix was increased to 46° C., and the agitated mix held for 20 min. The mix was cooled to 43° C.

To this mix, 24 parts by weight of demineralized water, 828 parts by weight of sodium carboxymethylate casein, 76 parts by weight of gelatin, and 1.5 parts by weight of a surfactant were added. The agitated mix was held for 10 min.

To this mix, 1814 parts by weight of demineralized water, 414 parts by weight of colloidal silica, 194 parts by weight of polyacrylamide, 84 parts by weight of surfactants, 25 parts by weight of resorcinol, 41 parts by weight of gelatin, 41 parts by weight of silicone, 4.3 parts by weight of propionic acid, and 0.7 parts by weight of chrome alum were added. The agitated mix was held for 15 min.

To this mix, 210 parts by weight of demineralized water, 76.1 parts by weight of surfactants, 16 parts by weight of caustic, 6.2 parts by weight of propionic acid, and 0.25 parts by weight of n-propyl alcohol were added. The agitated mix was cooled to 40° C. The pH was checked to be between 7 and 7.6.

This mix was supplied to an in-line mixer, where it was blended with a 40° C. stream comprising 6974 parts by weight of demineralized water, 1.8 parts by weight of bis (vinylsulfonyl)methane, and 2.2 parts by weight of potassium nitrate. The blended stream made up the back-layer coating mix that was supplied to the coating process.

Preparation of Back-Layer Coated Web

The back-layer coating mix was heated to 40° C. and applied continuously to a room temperature primed and subbed polyethylene terephthalate web, which was moving at a speed of 30 ft/min. The back-layer coating mix feed rate was adjusted to provide a dry back-layer coating weight of 10.77 $g/m^2$.

Preparation of Gelatin Under-Layer Coating Mix

This mix was prepared according to the procedure of Example 1.

Preparation of Under-Layer Coated Web

The under-layer coating mix was heated to 40° C. and applied continuously to the back-layer coated primed and subbed polyethylene terephthalate web, which was moving at a speed of 30.0 ft/min. This coating was applied to the side opposite that to which the back-layer coating had been applied. The under-layer coating mix feed rate was 61.0 g/min, resulting in a dry under-layer coating weight of 3.9 $g/m^2$. The coated web was dried continuously by moving past perforated plates through which room temperature air flowed. The pressure drop across the perforated plates was in the range of 0.8 to 3 in $H_2O$. The air dew point was in the range of 7 to 13° C.

Preparation of Image-Receiving Layer Coating Mix

This mix was prepared according to the procedure of Example 1.

Preparation of Image-Receiving Layer Coated Film

The image-coating mix was heated to 40° C. and coated onto the under-layer coated surface of a room temperature primed and subbed polyethylene terephthalate web, which was moving at a speed of 30.0 ft/min. The image-receiving layer coating mix feed rate was 159.7 g/min or 174.8 g/min, resulting in dry image-receiving layer coating weights of 50.7 $g/m^2$ or 55.3 $g/m^2$, respectively. The coated film was dried continuously by moving past perforated plates through which room temperature air flowed. The pressure drop across the perforated plates was in the range of 0.8 to 3 in $H_2O$. The air dew point was in the range of 7 to 13° C.

Evaluation of Samples

The coated films were evaluated according the procedures of Example 1. The results are summarized in Table II, Samples I and J. Excellent back-coat adhesion was seen for both samples. Superior drying performance was achieved for the sample with the 55.3 g/m$^2$ image-receiving layer coating weight, without development of excessive curl.

Example 3

Preparation of Gelatin/Polymer Matte Back-Layer Coating Mix

To a mixing vessel, 1898 parts by weight of demineralized water, 1434 parts by weight of gelatin, and 14 parts by weight of silica coated polymer beads were added. The mix was agitated at room temperature for 15 min, after which the temperature of the mix was increased to 46° C., and the agitated mix held for 20 min. The mix was cooled to 43° C.

To this mix, 21 parts by weight of demineralized water, 409 parts by weight of sodium carboxymethylate casein, 38 parts by weight of gelatin, and 0.8 parts by weight of a surfactant were added. The agitated mix was held for 10 min.

To this mix, 896 parts by weight of water, 205 parts by weight of colloidal silica, 96 parts by weight of polyacrylamide, 41 parts by weight of surfactants, 12 parts by weight of resorcinol, 20 parts by weight of gelatin, 20 parts by weight of silicone, 2.1 parts by weight of propionic acid, and 0.4 parts by weight of chrome alum were added. The agitated mix was held for 15 min.

To this mix, 64 parts by weight of demineralized water, 38.1 parts by weight of surfactants, 3.2 parts by weight of caustic, 3.1 parts by weight of propionic acid, and 0.25 parts by weight of n-propyl alcohol were added. The agitated mix was cooled to 40° C. The pH was checked to be between 7 and 7.6.

This mix was supplied to an in-line mixer, where it was blended with a 40° C. stream comprising 9511 parts by weight of demineralized water, 0.9 parts by weight of bis (vinylsulfonyl)methane, and 2.2 parts by weight of potassium nitrate. The blended stream made up the back-layer coating mix that was supplied to the coating process.

Preparation of Back-Layer Coated Web

The back-layer coating mix was heated to 40° C. and applied continuously to a room temperature primed and subbed polyethylene terephthalate web, which was moving at a speed of 30 ft/min. The back-layer coating mix feed rate was adjusted to provide a dry back-layer coating weight of 3.97 g/m$^2$.

Preparation of Gelatin Under-Layer Coating Mix

This mix was prepared according to the procedure of Example 1.

Preparation of Under-Layer Coated Web

The under-layer coating mix was heated to 40° C. and applied continuously to the back-layer coated primed and subbed polyethylene terephthalate web, which was moving at a speed of 30.0 ft/min. This coating was applied to the side opposite that to which the back-layer coating had been applied. The under-layer coating mix feed rate was 61.0 g/min, resulting in a dry under-layer coating weight of 3.8 g/m$^2$. The coated web was dried continuously by moving past perforated plates through which room temperature air flowed. The pressure drop across the perforated plates was in the range of 0.8 to 3 in $H_2O$. The air dew point was in the range of 7 to 13° C.

Preparation of Image-Receiving Layer Coating Mix

This mix was prepared according to the procedure of Example 1.

Preparation of Image-Receiving Layer Coated Film

The image-coating mix was heated to 40° C. and coated onto the under-layer coated surface of a room temperature primed and subbed polyethylene terephthalate web, which was moving at a speed of 30.0 ft/min. The image-receiving layer coating mix feed rate was 159.7 g/min or 174.8 g/min, resulting in dry image-receiving layer coating weights of 50.7 g/m$^2$ or 56.2 g/m$^2$, respectively. The coated film was dried continuously by moving past perforated plates through which room temperature air flowed. The pressure drop across the perforated plates was in the range of 0.8 to 3 in $H_2O$. The air dew point was in the range of 7 to 13° C.

Evaluation of Samples

The coated films were evaluated according the procedures of Example 1. The results are summarized in Table II, Samples K and L. Excellent back-coat adhesion was seen for both samples. Superior drying performance was achieved for the sample with the 56.2 g/m$^2$ image-receiving layer coating weight, without development of excessive curl.

Example 4

Preparation of Mixes for Three-Layer Back-Coat

Three back-coat layer mixes were prepared—a bottom layer mix, an interlayer mix, an overcoat layer mix. The bottom layer mix contained 84.53 wt % demineralized water, 6.50 wt % gelatin, 3.40 wt % surfactants, 1.97 wt % colloidal silica, 1.42 wt % sodium carboxymethylate casein, 1.10 wt % polyacrylamide, 0.64 wt % silicone, 0.24 wt % propionic acid, 0.11 wt % resorcinol, 0.07 wt % caustic, and 0.02 wt % chrome alum. The interlayer mix contained 86.83 wt % demineralized water, 6.50 wt % gelatin, 1.97 wt % colloidal silica, 1.33 wt % surfactants, 1.42 wt % sodium carboxymethylate casein, 1.10 wt % polyacrylamide, 0.64 wt % silicone, 0.11 wt % resorcinol, 0.07 wt % propionic acid, 0.02 wt % chrome alum, and 0.02 wt % sulfuric acid. The overcoat layer mix contained 82.72 wt % water, 6.48 wt % gelatin, 4.92 wt % sodium carboxymethylate casein, 1.96 wt % colloidal silica, 1.33 wt % surfactants, 1.10 wt % polyacrylamide, 0.64 wt % silicone, 0.33 wt % silica coated polymer beads, 0.15 wt % sodium alkylarylpolyether sulfonate, 0.13 wt % caustic, 0.11 wt % resorcinol, 0.07 wt % propionic acid, 0.05 wt % chrome alum, 0.02 wt % 1-propanol, 0.01 wt % amphoteric fluorinated polymer, and 0.01 wt % ethanol.

A 1.8 wt % aqueous solution of bis(vinyl sulfonyl)methane (BVSM) was also prepared, to be in-line mixed with the back-coat interlayer mix as it was coated. This solution was in-line mixed with the back-coat interlayer mix as it was being coated, so that the overall amount of BVSM applied was 2% of the total gelatin in the three back-coat layers.

Preparation of Gelatin Under-Layer and Image-Receiving Coating Mixes

These mixes were prepared by procedures similar to those of Example 1. For the image-receiving coating mixes, use of two different poly(vinyl alcohol) solution concentrations was evaluated—one mix using a 7 wt % polymer solution and another using a 10 wt % polymer solution.

Preparation of the Coated Web

The under-layer coating mix and the three back-coat coating mixes were simultaneously applied to a primed and subbed polyethylene terephthalate web, so that the under-layer was coated on one surface of the web and the three back-coat layers were coated on the opposite surface of the web, with the bottom layer mix being applied to the web surface, the combined inline mixture of the interlayer mix and BVSM mix being simultaneously applied to the bottom layer coating, and the overcoat layer mix being simultaneously applied to the interlayer coating. The relative mass feed rates of the three back-coat mixes were 1:1:1.2 for the bottom layer coating mix, for the combination of the interlayer coating mix and the BVSM stream, and for the overcoat layer coating mix, respectively. Two under-layer feed rates were evaluated during the run, with the ratio of their mass feed rates to the total mass feed rates for the back-coat mixes being 1.4 and 1.6. The coatings were dried by procedures similar to those of Experiment 1. The back-coat layers totaled 3.7 g/m$^2$ dry coating weight, while the two different under-layer dry coating weights were 4.2 and 4.9 g/m$^2$.

The image-receiving layer coating mix was applied to the under-layer coating and dried in a second pass. The coating was dried as in Example 1. Image-receiving layer coating weights averaged 43.2 g/m$^2$.

Evaluation of Samples

The coated films were evaluated according the procedures of Example 1, except that 28 cm×22 cm films were used in the curl evaluation. The results are summarized in Table III. Back-coat adhesion was excellent for all samples.

TABLE I

| ID | Back-Coat Layer Weight (g/m$^2$) | Image Receiving Layer Coating Weight (g/m$^2$) | Under-Layer Coating Weight (g/m$^2$) | Curl at 50% RH (mm) | Curl at 80% RH (mm) | Curl at 20% RH (mm) | Back-Coat Layer Adhesion | Wetness |
|---|---|---|---|---|---|---|---|---|
| A | 11.29 | 50.5 | 3.9 | 1.500 | 1.625 | 0.000 | 4.0 | 2.750 |
| B | 11.29 | 55.6 | 3.9 | 1.875 | 2.250 | 0.500 | 4.3 | 0.500 |
| C | 11.26 | 50.6 | 5.9 | 1.375 | 2.125 | 1.000 | 4.0 | 0.500 |
| D | 11.26 | 55.4 | 5.9 | 2.000 | 3.250 | 1.000 | 3.0 | 0.000 |
| E | 12.19 | 50.7 | 3.9 | 1.000 | 1.750 | 0.000 | 4.3 | 3.500 |
| F | 12.19 | 56.0 | 3.9 | 1.500 | 2.625 | 0.000 | 2.3 | 1.000 |
| G | 12.01 | 50.7 | 5.9 | 1.750 | 1.875 | 0.625 | 4.0 | 0.750 |
| H | 12.01 | 55.6 | 5.9 | 1.625 | 3.250 | 0.875 | 3.3 | 0.000 |

TABLE II

| ID | Back-Coat Layer Weight (g/m$^2$) | Image Receiving Layer Coating Weight (g/m$^2$) | Under-Layer Coating Weight (g/m$^2$) | Curl at 50% RH (mm) | Curl at 80% RH (mm) | Curl at 20% RH (mm) | Back-Coat Layer Adhesion | Wetness |
|---|---|---|---|---|---|---|---|---|
| I | 10.77 | 50.7 | 3.9 | 0.500 | 2.125 | 0.000 | 5.0 | 2.750 |
| J | 10.77 | 55.3 | 3.9 | 0.625 | 2.750 | 0.000 | 5.0 | 0.750 |
| K | 3.97 | 50.7 | 3.8 | 0.375 | 2.125 | 0.625 | 5.0 | 3.750 |
| L | 3.97 | 56.2 | 3.8 | 1.250 | 2.500 | 1.250 | 5.0 | 0.500 |

TABLE III

| ID | Under-Layer Coating Weight (g/m$^2$) | Back-Coat Adhesion | Curl at 22° C. and 25% R.H. (mm) | Curl at 20° C. and 50% R.H. (mm) | Curl at 20° C. and 89% R.H. (mm) | Wetness at 20° C. and 88% R.H. | Wetness at 20° C. and 57% R.H. |
|---|---|---|---|---|---|---|---|
| M | 4.2 | 5 | 2.375 | 2.375 | 3.250 | 1.25 | 0.25 |
| N | 4.2 | 5 | 1.375 | 2.000 | 2.875 | 1.50 | 0.50 |
| O | 4.9 | 5 | 1.875 | 2.000 | 3.375 | 1.50 | 0.50 |

Example 5

Preparation of Primer and Subbing Coated Substrate

A first mix was prepared comprising: 73.2 parts by weight water; 24.2 parts by weight of a terpolymer of monomers comprising about 83 wt % vinylidene chloride, about 15 wt % methyl acrylate, and about 2 wt % itaconic acid; 1.6 parts by weight of a 65.4% aqueous solution of saponin; and 1 part by weight resorcinol. This first mix was applied at 50° C. to both sides of a blue-tinted polyethylene terephthalate web, which was then dried and stretched. The resulting primer layers had dry coating weights averaging 0.112 g/m$^2$ on a dry basis.

A second mix was prepared comprising: 98.74 parts by weight water; 0.16 parts by weight potassium acetate; 0.84 parts by weight gelatin; 0.011 parts by weight saponin; 0.0075 parts by weight poly(methyl methacrylate-co-ethylene glycol dimethacrylate); and 0.000062 parts by weight chrome alum. This second mix was applied at 50° C. to both sides of the primer coated polyethylene terephthalate web. The resulting subbing layers had dry coating weights averaging 0.143 g/m$^2$ on a dry basis.

Preparation of Mixes for Three-Layer Back-Coat

Three back-coat layer mixes were prepared—a bottom layer mix, an interlayer mix, and an overcoat layer mix. The bottom layer mix contained 84.53 wt % demineralized water, 6.50 wt % gelatin, 3.40 wt % surfactants, 1.97 wt % colloidal silica, 1.42 wt % sodium carboxymethylate casein, 1.10 wt % polyacrylamide, 0.64 wt % silicone, 0.24 wt % propionic acid, 0.11 wt % resorcinol, 0.07 wt % caustic, and 0.02 wt % chrome alum. The interlayer mix contained 86.83 wt % demineralized water, 6.50 wt % gelatin, 1.97 wt % colloidal silica, 1.33 wt % surfactants, 1.42 wt % sodium carboxymethylate casein, 1.10 wt % polyacrylamide, 0.64 wt % silicone, 0.11 wt % resorcinol, 0.07 wt % propionic acid, 0.02 wt % chrome alum, and 0.02 wt % sulfuric acid. The overcoat layer mix contained 82.72 wt % water, 6.48 wt % gelatin, 4.92 wt % sodium carboxymethylate casein, 1.96 wt % colloidal silica, 1.33 wt % surfactants, 1.10 wt % polyacrylamide, 0.64 wt % silicone, 0.33 wt % silica coated polymer beads, 0.15 wt % sodium alkylarylpolyether sulfonate, 0.13 wt % caustic, 0.11 wt % resorcinol, 0.07 wt % propionic acid, 0.05 wt % chrome alum, 0.02 wt % 1-propanol, 0.01 wt % amphoteric fluorinated polymer, and 0.01 wt % ethanol.

A 1.8 wt % aqueous solution of bis(vinylsulfonyl)methane (BVSM) was also prepared. In Examples 6-8 that follow, this solution was in-line mixed with the back-coat interlayer mix as it was being coated, so that the overall amount of BVSM applied was 2% of the total gelatin in the three back-coat layers.

Example 6

Preparation of Gelatin Under-Layer Coating Mix

To a mixing vessel, 342.3 parts by weight of demineralized water was introduced. 26.7 parts by weight of gelatin was added to the agitated vessel and allowed to swell. This mix was heated to 60° C. and held until the gelatin was fully dissolved. The mix was then cooled to 50° C. To this mix, 12.0 parts by weight of borax (sodium tetraborate decahydrate) was added and mixed until the borax was fully dissolved. To this mix, 41.1 parts by weight of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 9.1 parts by weight of a 10 wt % aqueous solution of nonyl phenol, glycidyl polyether (Surfactant 10G) and 13.3 parts by weight of demineralized water were then added and mixed until homogeneous.

Preparation of Image-Receiving Layer Coating Mix

An alumina mix was prepared at room temperature by mixing 75.42 parts by weight of a 9.7 wt % aqueous solution of nitric acid and 764.6 parts by weight of demineralized water. To this mix, 360.0 parts by weight of alumina powder (DISPERAL® HP-14) was added over 30 min. The mix was heated to 80° C. and stirred for 30 min.

To this agitated mix were added 313.0 parts by weight of a 10 wt % aqueous solution of poly(vinyl alcohol) (CELVOL® 540) and 29.0 parts by weight of a 10 wt % aqueous solution of nonyl phenol, glycidyl polyether (Surfactant 10G). This mix was agitated for and additional 20 min prior to use.

Preparation of the Coated Web

The under-layer coating mix of this example and the three back-coat coating mixes of Example 5 were simultaneously applied to the primed and subbed polyethylene terephthalate web of Example 5, so that the under-layer was coated on one subbing-coated surface of the web and the three back-coat layers were coated on the opposite subbing-coated surface of the web, with the bottom layer mix being applied to the subbing layer, the combined inline mixture of the interlayer mix and BVSM mix being simultaneously applied to the bottom layer coating, and the overcoat layer mix being simultaneously applied to the interlayer coating. The relative mass feed rates of the three back-coat mixes were 1:1.2:1.2 for the bottom layer coating mix, for the combination of the interlayer coating mix and the BVSM stream, and for the overcoat layer coating mix, respectively. The ratio of the under-layer coating mix mass feed rate to the total mass feed rates for the back-coat mixes, including the BVSM stream, was 1.3. The coated web was dried continuously by moving past perforated plates through which room temperature air flowed. The pressure drop across the perforated plates was in the range of 0.2 to 5 in $H_2O$. The air dew point was in the range of −4 to 12° C.

The back-coat layers totaled 3.7 g/m$^2$ dry coating weight, while the under-layer dry coating weight was 4.2 g/m$^2$.

The image-receiving layer coating mix of this example was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 43.7 g/m$^2$.

Example 7

Preparation of Gelatin Under-Layer Coating Mix

To a mixing vessel, 342.3 parts by weight of demineralized water was introduced. 26.7 parts by weight of gelatin was added to the agitated vessel and allowed to swell. This mix was heated to 60° C. and held until the gelatin was fully dissolved. The mix was then cooled to 50° C. To this mix, 12.0 parts by weight of borax (sodium tetraborate decahydrate) was added and mixed until the borax was fully dissolved. To this mix, 41.1 parts by weight of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 9.1 parts by weight of a 10 wt % aqueous solution of nonyl phenol, glycidyl polyether (Surfactant 10G) and 13.3 parts by weight of demineralized water were then added and mixed until homogeneous.

Preparation of Image-Receiving Layer Coating Mix

An alumina mix was prepared at room temperature by mixing 75.42 parts by weight of a 9.7 wt % aqueous solution of nitric acid and 764.6 parts by weight of demineralized water. To this mix, 360.0 parts by weight of alumina powder (DISPERAL® HP-14) was added over 30 min. The mix was heated to 80° C. and stirred for 30 min.

To this agitated mix were added 447.1 parts by weight of a 7 wt % aqueous solution of poly(vinyl alcohol) (CELVOL® 540) and 29.0 parts by weight of a 10 wt % aqueous solution of nonyl phenol, glycidyl polyether (Surfactant 10G). This mix was agitated for and additional 20 min prior to use.

Preparation of the Coated Web

The under-layer coating mix of this example and the three back-coat coating mixes of Example 5 were simultaneously applied to the primed and subbed polyethylene terephthalate web of Example 5, so that the under-layer was coated on one subbing-coated surface of the web and the three back-coat layers were coated on the opposite subbing-coated surface of the web, with the bottom layer mix being applied to the subbing layer, the combined inline mixture of the interlayer mix and BVSM mix being simultaneously applied to the bottom layer coating, and the overcoat layer mix being simultaneously applied to the interlayer coating. The relative mass feed rates of the three back-coat mixes were 1:1.2:1.2 for the bottom layer coating mix, for the combination of the interlayer coating mix and the BVSM stream, and for the overcoat layer coating mix, respectively. The ratio of the under-layer coating mix mass feed rate to the total mass feed rates for the back-coat mixes, including the BVSM stream, was 1.3. The coated web was dried continuously by moving past perforated plates through which room temperature air flowed. The pressure drop across the perforated plates was in the range of 0.2 to 5 in $H_2O$. The air dew point was in the range of −4 to 12° C.

The back-coat layers totaled 3.7 g/m$^2$ dry coating weight, while the under-layer dry coating weight was 4.2 g/m$^2$.

The image-receiving layer coating mix of this example was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 43.0 g/m$^2$.

Example 8

Preparation of Gelatin Under-Layer Coating Mix

To a mixing vessel, 342.3 parts by weight of demineralized water was introduced. 26.7 parts by weight of gelatin was added to the agitated vessel and allowed to swell. This mix was heated to 60° C. and held until the gelatin was fully dissolved. The mix was then cooled to 50° C. To this mix, 12.0 parts by weight of borax (sodium tetraborate decahydrate) was added and mixed until the borax was fully dissolved. To this mix, 41.1 parts by weight of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 9.1 parts by weight of a 10 wt % aqueous solution of nonyl phenol, glycidyl polyether (Surfactant 10G) and 13.3 parts by weight of demineralized water were then added and mixed until homogeneous.

Preparation of Image-Receiving Layer Coating Mix

An alumina mix was prepared at room temperature by mixing 75.42 parts by weight of a 9.7 wt % aqueous solution of nitric acid and 764.6 parts by weight of demineralized water. To this mix, 360.0 parts by weight of alumina powder (DISPERAL® HP-14) was added over 30 min. The mix was heated to 80° C. and stirred for 30 min.

To this agitated mix were added 447.1 parts by weight of a 7 wt % aqueous solution of poly(vinyl alcohol) (CELVOL® 540) and 29.0 parts by weight of a 10 wt % aqueous solution of nonyl phenol, glycidyl polyether (Surfactant 10G). This mix was agitated for an additional 20 min prior to use.

Preparation of the Coated Web

The under-layer coating mix of this example and the three back-coat coating mixes of Example 5 were simultaneously applied to the primed and subbed polyethylene terephthalate web of Example 5, so that the under-layer was coated on one subbing-coated surface of the web and the three back-coat layers were coated on the opposite subbing-coated surface of the web, with the bottom layer mix being applied to the subbing layer, the combined inline mixture of the interlayer mix and BVSM mix being simultaneously applied to the bottom layer coating, and the overcoat layer mix being simultaneously applied to the interlayer coating. The relative mass feed rates of the three back-coat mixes were 1:1.2:1.2 for the bottom layer coating mix, for the combination of the interlayer coating mix and the BVSM stream, and for the overcoat layer coating mix, respectively. The ratio of the under-layer coating mix mass feed rate to the total mass feed rates for the back-coat mixes was 1.5. The coated web was dried continuously by moving past perforated plates through which room temperature air flowed. The pressure drop across the perforated plates was in the range of 0.2 to 5 in $H_2O$. The air dew point was in the range of −4 to 12° C.

The back-coat layers had a combined total 3.7 g/m$^2$ dry coating weight, while the under-layer dry coating weight was 4.9 g/m$^2$.

The image-receiving layer coating mix of this example was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 42.9 g/m$^2$.

Example 9

Preparation of Mixes for Three-Layer Back-Coat

Three back-coat layer mixes were prepared—a bottom layer mix, an interlayer mix, and an overcoat layer mix. The bottom layer mix contained 88.52 wt % demineralized water, 9.80 wt % gelatin, 1.49 wt % surfactants, 0.12 wt % propionic acid, and 0.07 wt % caustic. The interlayer mix contained 90.95 wt % demineralized water, 9.04 wt % gelatin, and 0.01 wt % sulfuric acid. The overcoat layer mix contained 90.81 wt % water, 7.64 wt % gelatin, 0.90 wt % silica coated polymer beads, 0.42 wt % sodium alkylarylpolyether sulfonate, 0.13 wt % caustic, 0.06 wt % 1-propanol, 0.02 wt % amphoteric fluorinated polymer, and 0.02 wt % ethanol.

A 1.8 wt % aqueous solution of bis(vinylsulfonyl)methane (BVSM) was also prepared. This solution was in-line mixed with the back-coat interlayer mix as it was being coated, so that the overall amount of BVSM applied was 2% of the total gelatin in the three back-coat layers.

Preparation of Gelatin Under-Layer Coating Mix

To a mixing vessel, 385.0 parts by weight of demineralized water was introduced. 30.0 parts by weight of gelatin was added to the agitated vessel and allowed to swell. This mix was heated to 60° C. and held until the gelatin was fully dissolved. The mix was then cooled to 50° C. To this mix, 13.5 parts by weight of borax (sodium tetraborate decahydrate) was added and mixed until the borax was fully dissolved. To this mix, 46.2 parts by weight of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 10.2 parts by weight of a 10 wt % aqueous solution of nonyl phenol, glycidyl polyether (Surfactant 10G) and 15.0 parts by weight of demineralized water were then added and mixed until homogeneous.

Preparation of Image-Receiving Layer Coating Mix

An alumina mix was prepared at room temperature by mixing 75.42 parts by weight of a 9.7 wt % aqueous solution of nitric acid and 764.6 parts by weight of demineralized water. To this mix, 360.0 parts by weight of alumina powder (DISPERAL® HP-14) was added over 30 min. The mix was heated to 80° C. and stirred for 30 min.

To this agitated mix were added 447.1 parts by weight of a 7 wt % aqueous solution of poly(vinyl alcohol) (CELVOL® 540) and 29.0 parts by weight of a 10 wt % aqueous solution of nonyl phenol, glycidyl polyether (Surfactant 10G). This mix was agitated for an additional 20 min prior to use.

Preparation of the Coated Web

The under-layer coating mix and the three back-coat coating mixes were simultaneously applied to the primed and subbed polyethylene terephthalate web of Example 5, so that the under-layer was coated on one subbing-coated surface of the web and the three back-coat layers were coated on the opposite subbing-coated surface of the web, with the bottom layer mix being applied to the subbing layer, the combined inline mixture of the interlayer mix and BVSM mix being simultaneously applied to the bottom layer coating, and the overcoat layer mix being simultaneously applied to the interlayer coating. The relative mass feed rates of the three back-coat mixes were 1:2.2:0.3 for the bottom layer coating mix, for the combination of the interlayer coating mix and the BVSM stream, and for the overcoat layer coating mix, respectively. The ratio of the under-layer coating mix mass feed rate to the total mass feed rates for the back-coat mixes was 1.2. The coated web was dried continuously by moving past perforated plates through which room temperature air flowed. The pressure drop across the perforated plates was in the range of 0.2 to 5 in $H_2O$. The air dew point was in the range of −4 to 10° C.

The back-coat layers had a combined total 4.7 g/m$^2$ dry coating weight, while the under-layer dry coating weight was 5.2 g/m$^2$.

The image-receiving layer coating mix was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 49.6 g/m$^2$.

Example 10

Evaluation of Film Samples for Ink Drying

The coated films of Examples 6-9 were imaged with an EPSON® 4900 ink-jet printer using a Wasatch Raster Image Processor (RIP). Table IV summarizes the wetness values for the films, printed at room temperature under both 84-88% relative humidity and 53-56% relative humidity. Under the lower humidity conditions, all films showed superior to excellent ink drying performance. The film of Example 9 continued to exhibit excellent ink drying performance under conditions of high humidity.

Evaluation of Film Samples for Coating Layer-Substrate Adhesion

Adhesion of the layers of coated films of Examples 6-9 was evaluated. Table V summarizes the room temperature adhesion values for the films. All films were evaluated for image-receiving layer side adhesion at 20%, 50%, and 80% relative humidity and for back-coat layer side adhesion at 20%, 50%, and 80% relative humidity. All films exhibited excellent coating-substrate adhesion for both sides under all conditions tested.

TABLE IV

| ID | Wetness Value 53-57% RH | Wetness Value 84-88% RH |
|---|---|---|
| 6 | 0.25 | 1.75 |
| 7 | 0.75 | 2.75 |
| 8 | 0.50 | 1.75 |
| 9 | 0.00 | 0 to 0.125 |

TABLE V

| ID | Adhesion Image Layer Side 80% RH | Adhesion Image Layer Side 50% RH | Adhesion Image Layer Side 20% RH | Adhesion Back-Coat Layer Side 80% RH | Adhesion Back-Coat Layer Side 50% RH | Adhesion Back-Coat Layer Side 20% RH |
|---|---|---|---|---|---|---|
| 6 | 5 | 5 | 5 | 5 | 5 | 5 |
| 7 | 5 | 5 | 5 | 5 | 5 | 5 |
| 8 | 5 | 5 | 5 | 5 | 5 | 5 |
| 9 | 5 | 5 | 5 | 5 | 5 | 5 |

Example 11

Preparation of Bottom Back-Layer Coating Mix

To a mixing vessel, 2827 parts by weight of demineralized water was introduced. 137 parts of gelatin was added to the agitated vessel and allowed to swell. The mix was heated to 50° C., held for 15 min, and then cooled to 43° C. To this mixture was added 55 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 94 parts of a 28 wt % aqueous solution of polyacrylamide and 21 parts of a 2.2 wt % aqueous solution of chrome alum, which was allowed to mix for 3 min. To the resulting mixture was added 172 parts of an aqueous solution comprising 20 wt % surfactants, 9 wt % gelatin, and 9 wt % silicone, which was allowed to mix for 10 min. To the resulting mixture was added 7 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively. To the resulting mixture was added 18 parts of an aqueous solution comprising 12 wt % VERSA-TL® 502, 99 ppm KATHON® LX, and 80 ppb cupric(II) nitrate hemipentahydrate, which was allowed to mix for 5 min.

Preparation of Middle Back-Layer Coating Mix

To a mixing vessel, 2217 parts by weight of demineralized water was introduced. 110 parts of gelatin was added to the agitated vessel and allowed to swell. The mix was heated to 50° C., held for 15 min, and then cooled to 43° C. To this mixture was added 18 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 145 parts of a 28 wt % aqueous solution of polyacrylamide and 21 parts of a 2.2 wt % aqueous solution of chrome alum, which was allowed to mix for 3 min. To the resulting mixture was added 532 parts of an aqueous solution comprising 20 wt % surfactants, 9 wt % gelatin, and 9 wt % silicone, which was allowed to mix for 10 min. To this mixture was added 167 parts of an aqueous solution comprising 36 wt % surfactant and 3 wt % propionic acid, 8 parts demineralized water, 7 parts of an aqueous solution comprising 21 wt % n-propyl alcohol and 8 wt % surfactant, and 15 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Top Back-Layer Coating Mix

To a mixing vessel, 3100 parts by weight of demineralized water was introduced. 169 parts of gelatin and 306 parts of an aqueous mixture comprising 9 wt % gelatin and 8 wt % silica coated polymer beads were added to the agitated vessel. The mix was heated to 50° C., held for 15 min, and then cooled to 43° C. To this mixture was added 190 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 131 parts of a 28 wt % aqueous solution of polyacrylamide and 29 parts of a 2.2 wt % aqueous solution of chrome alum, which was allowed to mix for 3 min. To the resulting mixture was added 240 parts of an aqueous solution comprising 20 wt % surfactants, 9 wt % gelatin, and 9 wt % silicone, which was allowed to mix for 10 min. To this mixture was added 167 parts of an aqueous solution comprising 36 wt % surfactant and 3 wt % propionic acid, 8 parts demineralized water, 7 parts of an aqueous solution comprising 21 wt % n-propyl alcohol and 8 wt % surfactant, and 15 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Back-Layer Coated Web

The bottom, middle, and top back-layer coating mixes were heated to 40° C. and applied continuously to a primed and subbed polyethylene terephthalate web, which was moving at a speed of 90 ft/min. (The bottom layer was the one closest to the web, while the top layer was the one farthest from the web.) The bottom back-layer coating mix feed rate was 21 g/m$^2$, the middle back-layer coating mix feed rate was 9 g/m$^2$, and the top back-layer coating mix feed rate was 16 g/m$^2$, resulting in a dry back-layer coating weight of 3.0 g/m$^2$ and a dry coverage of silica coated polymer beads of 43 mg/m$^2$. The coated web was dried continuously by moving past perforated plates through which room temperature air flowed. The pressure drop across the perforated plates was in the range of 0.8 to 3 in $H_2O$. The air dew point was in the range of 7 to 13° C.

Preparation of Gelatin Under-Layer Coating Mix

To a mixing vessel, 9995 parts by weight of demineralized water was introduced. 528 parts of gelatin was added to the agitated vessel and allowed to swell. This mix was heated to 60° C. and held until the gelatin was fully dissolved. The mix was then cooled to 50° C. To this mix, 238 parts of borax (sodium tetraborate decahydrate) was added and mixed until the borax was fully dissolved. To this mix, 59 parts of an aqueous solution of 12 wt % sulfonated polystyrene (VERSA-TL® 502, AkzoNobel) and 0.2 wt % microbiocide (KATHON® LX, Dow) was added and mixed until homogeneous. The mix was then cooled to 40° C. 180 parts of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The weight ratio of borax to gelatin in the resulting under-layer coating mix was 0.45:1.

Preparation of Under-Layer Coated Web

The under-layer coating mix was heated to 40° C. and applied continuously to the back-layer coated primed and subbed polyethylene terephthalate web, which was moving at a speed of 90 ft/min. This coating was applied to the side opposite that to which the back-layer coating had been applied. The under-layer coating mix feed rate was 82 g/m$^2$, resulting in a dry under-layer coating weight of 5.2 g/m$^2$. The coated web was dried continuously by moving past perforated plates through which room temperature air flowed. The pressure drop across the perforated plates was in the range of 0.8 to 3 in $H_2O$. The air dew point was in the range of 7 to 13° C.

Preparation of Poly(Vinyl Alcohol) Mix

A poly(vinyl alcohol) mix was prepared at room temperature by adding 400 parts by weight of poly(vinyl alcohol) (CELVOL® 540) to a mixing vessel containing 3600 parts demineralized water over 10 min with 500 rpm agitation. This mixture was heated to 85° C. and agitated for 30 minutes. The mixture was then allowed to cool to room temperature. Demineralized water was added to make up for water lost due to evaporation.

Preparation of Alumina Mix

An alumina mix was prepared at room temperature by mixing 220 parts by weight of a 22 wt % aqueous solution of nitric acid and 8030 parts of demineralized water. To this mix, 2750 parts of alumina powder (DISPERAL® HP-14) was added over 30 min. The pH of the mix was adjusted to 2.56 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 1756 parts by weight of the 10 wt % aqueous solution of poly(vinyl alcohol) (CELVOL® 540) into a mixing vessel and agitating. To this mix, 8080 parts of the alumina mix and 163 parts of a 10 wt % aqueous solution of nonyl phenol, glycidyl polyether (Surfactant 10G) were added. The mix was cooled to room temperature and held for gas bubble disengagement prior to use.

Preparation of Image-Receiving Layer Coated Film

The image-coating mix was heated to 40° C. and coated onto the under-layer coated surface of a room temperature primed and subbed polyethylene terephthalate web, which was moving at a speed of 30 ft/min. The image-receiving layer coating mix feed rate was 206 g/min, resulting in a dry image-receiving layer coating weight of 51 g/m$^2$. The coated film was dried continuously by moving past perforated plates through which room temperature air flowed. The pressure drop across the perforated plates was in the range of 0.8 to 3 in $H_2O$. The air dew point was in the range of 7 to 13° C.

Evaluation of Coated Film

The results of the film evaluation are shown in Table VI.

Example 12

The procedure according to Example 11 was repeated, with the following changes. The top back-layer coating mix composition comprised 86.2 wt % water, 5.2 wt % gelatin, 4.0 wt % sodium carboxymethylate casein, 2.4 wt % surfactants, 0.9 wt % polyacrylamide, 0.5 wt % silica coated polymer beads, and 0.5 wt % silicone, resulting in a dry back-layer coating weight of 3.1 g/m$^2$ and a dry coverage of silica coated polymer beads of 86 mg/m$^2$.

Evaluation of Coated Film

The results of the film evaluation are shown in Table VI.

Example 13

The procedure according to Example 11 was repeated, with the following changes. The top back-layer coating mix composition comprised 85.9 wt % water, 5.3 wt % gelatin, 4.0 wt % sodium carboxymethylate casein, 2.4 wt % surfactants, 0.9 wt % polyacrylamide, 0.8 wt % silica coated polymer beads, and 0.5 wt % silicone, resulting in a dry back-layer coating weight of 3.2 g/m$^2$ and a dry coverage of silica coated polymer beads of 129 mg/m$^2$.

Evaluation of Coated Film

The results of the film evaluation are shown in Table VI.

Example 14

The procedure according to Example 11 was repeated, with the following changes. The top back-layer coating mix composition comprised 84.8 wt % water, 5.2 wt % gelatin, 4.0 wt % sodium carboxymethylate casein, 3.5 wt % surfactants, 1.0 wt % silicone, 0.9 wt % polyacrylamide, and 0.3 wt % silica coated polymer beads, resulting in a dry back-layer coating weight of 3.0 g/m$^2$ and a dry coverage of silica coated polymer beads of 43 mg/m$^2$.

Evaluation of Coated Film

The results of the film evaluation are shown in Table VI.

Example 15

The procedure according to Example 11 was repeated, with the following changes. Both the middle back-layer coating mix and the bottom back-layer coating mix comprised 95.2 wt % water and 4.7 wt % gelatin. This resulted in a dry back-layer coating weight of 2.5 g/m$^2$ and a dry coverage of silica coated polymer beads of 43 mg/m$^2$.

Evaluation of Coated Film

The results of the film evaluation are shown in Table VI.

Example 16

The procedure according to Example 11 was repeated, but using the top back-layer coating mix of Example 12 and the middle and bottom back-layer coating mixes of Example 15. This resulted in a dry back-layer coating weight of 2.7 g/m$^2$ and a dry coverage of silica coated polymer beads of 86 mg/m$^2$.

Evaluation of Coated Film

The results of the film evaluation are shown in Table VI.

Example 17

The procedure according to Example 11 was repeated, but using the top back-layer coating mix of Example 13 and the middle and bottom back-layer coating mixes of Example 15. This resulted in a dry back-layer coating weight of 2.7 g/m$^2$ and a dry coverage of silica coated polymer beads of 129 mg/m$^2$.

Evaluation of Coated Film

The results of the film evaluation are shown in Table VI.

Example 18

The procedure according to Example 11 was repeated, but using the top back-layer coating mix of Example 14 and the middle and bottom back-layer coating mixes of Example 15. This resulted in a dry back-layer coating weight of 2.7 g/m$^2$ and a dry coverage of silica coated polymer beads of 43 mg/m$^2$.

Evaluation of Coated Film

The results of the film evaluation are shown in Table VI.

Example 19

Preparation of Bottom Back-Layer Coating Mix

To a mixing vessel, 307.0 parts by weight of demineralized water was introduced. 46.0 parts of gelatin was added to the agitated vessel. The mix was then heated to 60° C. To the resulting mixture was added 20.8 parts of an aqueous solution comprising 36 wt % of a surfactant and 2.9 wt % propionic acid and 4.3 parts demineralized water, which was allowed to mix for 1 min. To the resulting mixture was added 1.1 parts of a 25 wt % aqueous solution of caustic and 4.1 parts demineralized water, which was allowed to mix for 4 min. The resulting mixture was allowed to cool to 40° C.

Preparation of Middle Back-Layer Coating Mix

To a mixing vessel, 319.3 parts by weight of demineralized water was introduced. 38.0 parts of gelatin was added to the agitated vessel. The mix was then heated to 60° C. To the resulting mixture was added 1.2 parts of an aqueous solution comprising 5 wt % sulfuric acid and 3.4 parts demineralized water, which was allowed to mix for 4 min. The resulting mixture was allowed to cool to 40° C.

Preparation of Top Back-Layer Coating Mix

To a mixing vessel, 33.0 parts by weight of a solution comprising 87.4 wt % sodium carboxymethylate casein, 8.0 wt % gelatin, 4.4 wt % water, and 0.2 wt % surfactant, 46.1 parts of an aqueous mixture comprising 9 wt % gelatin and 8 wt % silica coated polymer beads, 22.8 parts of a 28 wt % aqueous solution of polyacrylamide, 27.5 parts gelatin, and 323.0 parts demineralized water were added. The mix was heated to 60° C. To the resulting mixture was added 12.8 parts of a 2.2 wt % aqueous solution of chrome alum and 28.5 parts demineralized water, then was added 11.3 parts of an 8 wt % aqueous solution of sodium arylarylpolyether sulfonate and 28.5 parts demineralized water, followed by 0.8 parts of an aqueous solution comprising 15 wt % 1-propanol, 5 wt % of an amphoteric fluorinated polymer, and 5 wt % ethanol, 2.8 parts demineralized water, and 41.8 parts of an aqueous solution comprising 18 wt % surfactants, 9 wt % gelatin, 9 wt % silicone, and 0.1 wt % propionic acid, which was allowed to mix for 4 min. To this mixture was added 3.0 parts of a 25 wt % aqueous solution of caustic and 2.8 parts demineralized water. The resulting mixture was allowed to cool to 40° C.

Preparation of the BVSM Mix

A 1.8 wt % aqueous solution of bis(vinylsulfonyl)methane (BVSM) was also prepared. This mix was in-line mixed with the Middle Back-Layer Coating Mix as it was being coated, with the feed rate chosen so that the overall amount of BVSM applied was 2 wt % relative to the total gelatin in the three back-coat layers.

Preparation of Gelatin Under-Layer Coating Mix

To a mixing vessel, 998 parts by weight of demineralized water was introduced. 78 parts of gelatin was added to the agitated vessel and allowed to swell. This mix was heated to 60° C. The mix was then cooled to 46° C. To this mix, 35 parts of borax (sodium tetraborate decahydrate) was added and held for 15 min. To this mix, 120 parts of an aqueous solution of 32.5 wt % sulfonated polystyrene (VERSA-TL® 502, AkzoNobel) and 0.2 wt % microbiocide (KATHON® LX, Dow) was added and mixed until homogeneous. The mix was then cooled to 40° C. 26 parts of a 10 wt % aqueous solution of nonyl phenol, glycidyl polyether (Surfactant 10G) and 39 parts demineralized water were then added and mixed until homogeneous. This mix was cooled to room temperature and held to allow disengagement of any gas bubbles prior to use. The weight ratio of borax to gelatin in the resulting under-layer coating mix was 0.45:1.

Preparation of Poly(Vinyl Alcohol) Mix

A poly(vinyl alcohol) mix was prepared at room temperature by adding 7 parts by weight of poly(vinyl alcohol) (CELVOL® 540) to a mixing vessel containing 93 parts of demineralized water over 10 min with 500 rpm agitation. This mixture was heated to 85° C. and agitated for 30 minutes. The mixture was then allowed to cool to room temperature. Demineralized water was added to make up for water lost due to evaporation.

Preparation of Alumina Mix

An alumina mix was prepared at room temperature by mixing 75.4 parts by weight of a 9.7 wt % aqueous solution of nitric acid and 764.6 parts of demineralized water. To this mix, 360 parts of alumina powder (DISPERAL®HP-14) was added over 30 min. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 470 parts of the alumina mix into a mixing vessel and agitating. The mix was heated to 40° C. To this mix, 175 parts by weight of the 7 wt % aqueous solution of poly(vinyl alcohol) (CELVOL® 540) and 11 parts of a 10 wt % aqueous solution of nonyl phenol, glycidyl polyether (Surfactant 10G) were added. After 30 min, the resulting mixture was cooled to room temperature and held for gas bubble disengagement prior to use.

Preparation of the Coated Web

The under-layer coating mix and the three back-coat coating mixes of were simultaneously applied to a primed and subbed polyethylene terephthalate web, so that the under-layer was coated on one surface of the web and the three back-coat layers were coated on the opposite surface of the web, with the bottom layer mix being applied to the web, the combined inline mixture of the middle layer mix and BVSM mix being simultaneously applied to the bottom layer coating, and the top layer mix being simultaneously applied to the middle layer coating. The relative mass feed rates of the three back-coat mixes were 3.9:5.8:4.3 for the bottom layer coating mix, for the combination of the interlayer coating mix and the BVSM stream, and for the overcoat layer coating mix, respectively. The ratio of the under-layer coating mix mass feed rate to the total mass feed rates for the back-coat mixes, including the BVSM stream, was 1.5. The coated web was dried continuously by moving past perforated plates through which room temperature air flowed. The pressure drop across the perforated plates was in the range of 0.2 to 5 in $H_2O$. The air dew point was in the range of −4 to 12° C.

The back-coat layers totaled 4.4 g/m$^2$ dry coating weight and a dry coverage of silica coated polymer beads of 80 mg/m$^2$, while the under-layer dry coating weight was 5.4 g/m$^2$.

The image-receiving layer coating mix was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 48.2 g/m$^2$.

Evaluation of Coated Film

The results of the film evaluation are shown in Table VII.

Example 20

The procedure according to Example 19 was repeated, except for the top back-coat coating mix, which was prepared according to the following procedure. To a mixing vessel, 33.0 parts by weight of a solution comprising 87.4 wt % sodium carboxymethylate casein, 8.0 wt % gelatin, 4.4 wt % water, and 0.2 wt % surfactant, 57.0 parts of an aqueous mixture comprising 9 wt % gelatin and 8 wt % silica coated polymer beads, 22.8 parts of a 28 wt % aqueous solution of polyacrylamide, 26.5 parts gelatin, and 313.0 parts demineralized water were added. The mix was heated to 60° C. To the resulting mixture was added 12.8 parts of a 2.2 wt % aqueous solution of chrome alum and 28.5 parts demineralized water, then was added 11.3 parts of an 8 wt % aqueous solution of sodium arylarylpolyether sulfonate and 28.5 parts demineralized water, followed by 0.8 parts of an aqueous solution comprising 15 wt % 1-propanol, 5 wt % of an amphoteric fluorinated polymer, and 5 wt % ethanol, 2.8 parts demineralized water, and 41.8 parts of an aqueous solution comprising 18 wt % surfactants, 9 wt % gelatin, 9 wt % silicone, and 0.1 wt % propionic acid, which was allowed to mix for 4 min. To this mixture was added 3.0 parts of a 25 wt % aqueous solution of caustic and 2.8 parts demineralized water. The resulting mixture was allowed to cool to 40° C.

Use of this top back-coat coating mix resulted in a dry back-layer coating weight of 4.3 g/m$^2$ and a dry coverage of silica coated polymer beads of 100 mg/m$^2$.

Evaluation of Coated Film

The results of the film evaluation are shown in Table VII.

Example 21

The procedure according to Example 19 was repeated, except for the top back-coat coating mix, which was prepared according to the following procedure. To a mixing vessel, 33.0 parts by weight of a solution comprising 87.4 wt % sodium carboxymethylate casein, 8.0 wt % gelatin, 4.4 wt % water, and 0.2 wt % surfactant, 71.3 parts of an aqueous mixture comprising 9 wt % gelatin and 8 wt % silica coated polymer beads, 22.8 parts of a 28 wt % aqueous solution of polyacrylamide, 26.5 parts gelatin, and 299.0 parts demineralized water were added. The mix was heated to 60° C. To the resulting mixture was added 12.8 parts of a 2.2 wt % aqueous solution of chrome alum and 28.5 parts demineralized water, then was added 11.3 parts of an 8 wt % aqueous solution of sodium arylarylpolyether sulfonate and 28.5 parts demineralized water, followed by 0.8 parts of an aqueous solution comprising 15 wt % 1-propanol, 5 wt % of an amphoteric fluorinated polymer, and 5 wt % ethanol, 2.8 parts demineralized water, and 41.8 parts of an aqueous solution comprising 18 wt % surfactants, 9 wt % gelatin, 9 wt % silicone, and 0.1 wt % propionic acid, which was allowed to mix for 4 min. To this mixture was added 3.0 parts of a 25 wt % aqueous solution of caustic and 2.8 parts demineralized water. The resulting mixture was allowed to cool to 40° C.

Use of this top back-coat coating mix resulted in a dry back-layer coating weight of 4.4 g/m$^2$ and a dry coverage of silica coated polymer beads of 125 mg/m$^2$.

Evaluation of Coated Film

The results of the film evaluation are shown in Table VII.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE VI

| Ex. | Bead Coverage (mg/m$^2$) | Wetness (20° C. 85% RH) | Wetness (20° C. 51% RH) | Ink Transfer (24 hrs) | Ink Transfer (7 days) | Back-Coat Adhesion | Back-Coat Roughness (sec) |
|---|---|---|---|---|---|---|---|
| 11 | 43 | 0.125 | 0.125 | 0 | 0 | 5 | 17.0 |
| 12 | 86 | 0.125 | <0.125 | 0 | 4 | 5 | 7.7 |
| 13 | 129 | 0.125 | <0.125 | 0 | 0 | 5 | 5.7 |
| 14 | 43 | 0.125 | <0.125 | 0 | 5 | 5 | 15.2 |
| 15 | 43 | 0.125 | <0.125 | 0 | 1 | 5 | 10.8 |
| 16 | 86 | 0.125 | <0.125 | 0 | 0 | 5 | 6.8 |
| 17 | 129 | 0.125 | <0.125 | 0 | 0 | 5 | 5.3 |
| 18 | 43 | 0.125 | <0.125 | 0 | 1 | 5 | 13.4 |

Notes:

1. At 85% relative humidity, the first wedges of all the samples were 0.125 wet, while the second wedges of all the samples were less than 0.125 wet.
2. At 51% relative humidity, the second wedges of all the samples were completely dry.
3. Ink Transfer measurements conducted at 85% relative humidity, under 5.7 psi (39 kPa) pressure, and with ¼-in × ¼-in size grid squares.
4. Back-coat adhesion values of 5 achieved for all samples at 85%, 50%, and 20% relative humidity.

TABLE VII

| Ex. | Bead Coverage (mg/m$^2$) | Wetness (20° C. 86% RH) | Wetness (24° C. 47% RH) | Ink Transfer (24 hrs) | Ink Transfer (4 days) | Ink Transfer (7 days) | Back-coat Roughness (sec) |
|---|---|---|---|---|---|---|---|
| 19 | 80 | 0.25-0.50 | 0 | 0 | 8.5 | 29 | 8.3 |
| 20 | 100 | 0.25-0.50 | 0 | 0 | 4.5 | 3.5 | 8.1 |
| 21 | 125 | 0.25-0.50 | 0 | 0 | 0 | 4.5 | 6.9 |

Notes:

1. At 86% relative humidity, the first wedges of all the samples were 0.25-0.50 wet, while the second wedges of all the samples were less than 0.125 wet.
2. Ink Transfer measurements conducted at 86% relative humidity, under 0.081 psi (560 Pa) pressure, and with ⅛-in × ⅛-in size grid squares.

What is claimed:

1. A transparent ink-jet recording film comprising:

a transparent substrate comprising a polyester, said substrate comprising at least a first surface and a second surface;

at least one under-layer disposed on the first surface, said at least one under-layer comprising gelatin and at least one borate or borate derivative;

at least one image-receiving layer disposed on the at least one under-layer, said at least one image-receiving layer comprising at least one inorganic particle and at least one water soluble or water dispersible polymer comprising at least one hydroxyl group; and at least one back-coat layer disposed on the second surface, said at least one back-coat layer comprising gelatin and at least one core-shell particle comprising at least one thermoplastic polymer.

2. The transparent ink-jet recording film according to claim 1, wherein the at least one back-coat layer further comprises at least one other hydrophilic colloid.

3. The transparent ink-jet recording film according to claim 1, wherein the at least one core-shell particle comprises a dry coverage of at least about 100 $mg/m^2$.

4. The transparent ink-jet recording film according to claim 1, wherein the at least one inorganic particle comprises boehmite alumina and the at least one water soluble or water dispersible polymer comprises poly(vinyl alcohol).

5. The transparent ink-jet recording film according to claim 1, wherein the at least one image-receiving layer comprises a dry coating weight of at least about 49 $g/m^2$.

6. The transparent ink-jet recording film according to claim 1, wherein the at least one thermoplastic polymer comprises a styrene allyl alcohol copolymer.

7. The transparent ink-jet recording film according to claim 1, wherein the at least one core-shell particle comprises a styrene allyl alcohol copolymer core and a colloidal silica shell.

8. The transparent ink-jet recording film according to claim 1, wherein the at least one back-coat layer further comprises at least one hardening agent.

9. The transparent ink-jet recording film according to claim 8, wherein the at least one back-coat layer comprises at least a first back-coat layer and a second back-coat layer, said first back-coat layer being disposed between the second back-coat layer and the second surface of the transparent substrate, wherein the first back-coat layer comprises gelatin and the at least one hardening agent, and the second back-coat layer comprises gelatin and the at least one core-shell particle.

10. The transparent ink-jet recording film according to claim 1, further comprising at least one first subbing layer disposed between the at least one under-layer and the first surface of the transparent substrate, said at least one first subbing layer comprising gelatin and at least one first polymeric matting agent.

11. The transparent ink-jet recording film according to claim 10, further comprising at least one primer layer disposed between the at least one first subbing layer and the first surface of the transparent substrate, said at least one primer layer comprising at least one latex polymer and at least one adhesion promoter.

12. The transparent ink-jet recording film according to claim 10, further comprising at least one second subbing layer disposed between the at least one back-coat layer and the second surface of the transparent substrate, said at least one second subbing layer comprising gelatin and at least one second polymeric matting agent.

13. The transparent ink-jet recording film according to claim 12, further comprising at least one primer layer disposed between the at least one second subbing layer and the second surface of the transparent substrate, said at least one primer layer comprising at least one latex polymer and at least one adhesion promoter.

14. The transparent ink-jet recording film according to claim 1 exhibiting an ink transfer measurement of zero squares transferred when subjected to 5.7 psi pressure and 85% relative humidity for seven days, wherein said ink transfer measurement is based on 390¼-in×¼-in grid squares.

15. The transparent ink-jet recording film according to claim 1 exhibiting an ink transfer measurement of zero squares transferred when subjected to 0.081 psi pressure and 86% relative humidity for four days, wherein said ink transfer measurement is based on 390⅛-in×⅛-in grid squares.

* * * * *